US008444753B2

(12) United States Patent
Hagino

(10) Patent No.: US 8,444,753 B2
(45) Date of Patent: May 21, 2013

(54) EXHAUST GAS PURIFYING SYSTEM, METHOD FOR MANUFACTURING THE EXHAUST GAS PURIFYING SYSTEM AND EXHAUST GAS PURIFYING METHOD USING THE EXHAUST GAS PURIFYING SYSTEM

(75) Inventor: Masashi Hagino, Takahama (JP)

(73) Assignee: Ibiden Co., Ltd., Ogaki-shi (JP)

( * ) Notice: Subject to any disclaimer, the term of this patent is extended or adjusted under 35 U.S.C. 154(b) by 168 days.

(21) Appl. No.: 13/092,160

(22) Filed: Apr. 22, 2011

(65) Prior Publication Data

US 2011/0259192 A1 Oct. 27, 2011

(30) Foreign Application Priority Data

Apr. 22, 2010 (JP) ..... 2010-099200

(51) Int. Cl.

| | |
|---|---|
| ***B01D 50/00*** | (2006.01) |
| ***B01D 39/06*** | (2006.01) |
| ***B01D 39/14*** | (2006.01) |
| ***B01D 46/00*** | (2006.01) |

(52) U.S. Cl.

USPC ..... 95/273; 55/522; 55/523; 55/524; 422/169; 422/170; 422/171; 422/172; 422/177; 422/178; 422/179; 422/180; 422/181; 422/182

(58) Field of Classification Search

USPC ..... 55/522–524; 95/273; 422/169–172, 422/177–182

See application file for complete search history.

(56) References Cited

U.S. PATENT DOCUMENTS

| | | | | |
|---|---|---|---|---|
| 3,798,006 | A * | 3/1974 | Balluff | 422/179 |
| 5,449,500 | A * | 9/1995 | Zettel | 422/179 |
| 2007/0048196 | A1 * | 3/2007 | Takeuchi | 422/179 |

FOREIGN PATENT DOCUMENTS

| | | |
|---|---|---|
| EP | 1752266 | 2/2007 |
| JP | 2006-161667 | 6/2006 |
| JP | 2007-092553 | 4/2007 |

OTHER PUBLICATIONS

Extended European Search Report for corresponding EP Application No. 11159541.9-2321, Jun. 7, 2011.

* cited by examiner

*Primary Examiner* — Amber Orlando
(74) *Attorney, Agent, or Firm* — Ditthavong Mori & Steiner, P.C.

(57) ABSTRACT

An exhaust gas purifying system includes an exhaust gas purifying apparatus provided with a gas inlet side connected to an inlet pipe and a gas outlet side connected to an exhaust pipe. A holding sealing material of the exhaust gas purifying apparatus has a first side face and a second side face. The first side face is positioned on the gas outlet side and has a first slanting face formed on the first side face. The first slanting face has a first inside end point and a first outside end point. The first inside end point is positioned between the gas inlet side and the first outside end point. The first slanting face extends from the first inside end point to the first outside end point and is tilted relative to an end face of an exhaust gas treating body of the exhaust gas purifying apparatus.

36 Claims, 19 Drawing Sheets

BACKGROUND ART

BACKGROUND ART

A-A line cross-sectional view

B–B line cross-sectional view

C–C line cross-sectional view

Example

Comparative Example

Example

Comparative Example

EXHAUST GAS PURIFYING SYSTEM, METHOD FOR MANUFACTURING THE EXHAUST GAS PURIFYING SYSTEM AND EXHAUST GAS PURIFYING METHOD USING THE EXHAUST GAS PURIFYING SYSTEM

CROSS-REFERENCE TO RELATED APPLICATIONS

The present application claims priority under 35 U.S.C. §119 to Japanese Patent Application No. 2010-099200, filed Apr. 22, 2010, the contents of which are incorporated herein by reference in their entirety.

BACKGROUND OF THE INVENTION

1. Field of the Invention

The present invention relates to an exhaust gas purifying system, a method for manufacturing the exhaust gas purifying system, and an exhaust gas purifying method using the exhaust gas purifying system.

2. Discussion of the Background

In exhaust gases discharged from an internal combustion engine such as a diesel engine, particulate matters (hereinafter, referred to as PMs) are contained, and in recent years, these PMs have raised serious problems as contaminants harmful to the environment and the human body. Moreover, exhaust gases also contain toxic gas components, such as CO (carbon monoxide), HC (hydrocarbon) or NOx (nitrogen oxides), and these toxic gas components have also raised serious problems as contaminants harmful to the environment and the human body.

Therefore, as the exhaust gas purifying apparatus that is coupled to an internal combustion engine so that PMs in exhaust gases are captured therein and toxic gas components contained in exhaust gases, such as CO, HC, NOx or the like, are purified, various exhaust gas purifying apparatuses have been proposed, each of which is composed of an exhaust gas treating body made from a porous ceramic material such as cordierite, silicon carbide, or the like, a metal casing used for housing the exhaust gas treating body therein, and a mat-shaped holding sealing material containing inorganic fibers, which is placed between the exhaust gas treating body and the metal casing.

In these exhaust gas purifying apparatuses, the holding sealing material is allowed to hold the exhaust gas treating body by the elasticity possessed by the inorganic fibers. Moreover, by filling a gap between the exhaust gas treating body and the metal casing with the holding sealing material, exhaust gases are prevented from leaking through a gap between the exhaust gas treating body and the metal casing.

As the method for manufacturing the exhaust gas purifying apparatus, a method has been known in which an exhaust gas treating body around which a holding sealing material is wound is stuffed (press-fitted) to the inside of a metal casing. As the metal casing, a metal casing, which has an inner diameter that is slightly shorter than the outer diameter (the combined length of the diameter of the exhaust gas treating body and the thickness of the holding sealing material) of the exhaust gas treating body around which the holding sealing material is wound, may be used.

In the present description, the exhaust gas treating body around which the holding sealing material has been wound is referred to also as "wound body".

In an exhaust gas purifying apparatus produced by using the aforementioned method, the holding sealing material is brought into a compressed state inside the metal casing. Consequently, the holding sealing material is allowed to exert a restoring force (that is, holding strength for holding the exhaust gas treating body) for trying to return to its original shape by the elasticity possessed by inorganic fibers so that the exhaust gas treating body is held by the holding sealing material.

Moreover, an inlet pipe for introducing exhaust gases into the exhaust gas purifying apparatus is connected to one of the ends of the exhaust gas purifying apparatus, and an exhaust pipe for externally discharging the exhaust gases that have passed through the exhaust gas purifying apparatus is connected to the other end of the exhaust gas purifying apparatus so that an exhaust gas purifying system can be manufactured.

In the present description, in the exhaust gas purifying apparatus, the side of the end portion to which the inlet pipe is connected is referred to as "gas inlet side", and the side of the end portion to which the exhaust pipe is connected is referred to as "gas outlet side".

However, in the exhaust gas purifying system manufactured by using the conventional method, problems arise in that the side face of the holding sealing material wound around the peripheral portion of the exhaust gas treating body forming the exhaust gas purifying apparatus tends to be deformed, and upon allowing exhaust gases to flow thereto, the holding sealing material is damaged.

Referring to FIG. 1, the following description will discuss this problem in detail.

FIG. 1 is a cross-sectional view that schematically illustrates one example of a conventional exhaust gas purifying system. In FIG. 1, the stuffing direction is indicated by an arrow "Z". In this manner, in the conventional exhaust gas purifying system, the stuffing direction and the flowing direction of exhaust gases are the same direction.

In a conventional exhaust gas purifying system 200 shown in FIG. 1, on the gas outlet side 212 of an exhaust gas purifying apparatus 210, the first side face 241 of a holding sealing material 240 is not made substantially in parallel with an outlet side end face 232 of an exhaust gas treating body 230 to cause a tilted state. Moreover, on the gas inlet side 211 of the exhaust gas purifying apparatus 210, the second side face 242 of the holding sealing material 240 is not made substantially in parallel with an inlet side end face 231 of the exhaust gas treating body 230 to cause a tilted state.

The reasons for this are presumably explained as follows: Upon stuffing the exhaust gas treating body 230 around which the holding sealing material 240 has been wound into a metal casing 220, a shearing force is exerted between a main face 245*a* (hereinafter, referred to also simply as a first main face) of the holding sealing material 240 that is made in contact with the exhaust gas treating body 230 and a main face 245*b* (hereinafter, referred to also simply as a second main face) of the holding sealing material 240 that is made in contact with the metal casing 220. The shearing force is exerted in a stuffing direction on the first main face 245*a* side of the holding sealing material 240, and is also exerted in a direction opposite to the stuffing direction on the second main face 245*b* side of the holding sealing material 240. It is considered that, as a result, the positions of the first main face 245*a* and the second main face 245*b* of the holding sealing material 240 are mutually displaced, with the result that the holding sealing material 240 is deformed.

Additionally, the expression "substantially in parallel with" indicates a state in which the end face (inlet side end face or outlet side end face) of the exhaust gas treating body is kept in parallel with the first side face or the second side face of the holding sealing material or a state in which, even when the first side face or the second side face of the holding sealing material is tilted relative to the end face of the exhaust gas treating body, the degree of the tilt can be virtually ignored.

As in the case of a conventional exhaust gas purifying system 200 shown in FIG. 1, in a state where, in an exhaust gas purifying apparatus 210, a first side face 241 and a second side face 242 of a holding sealing material 240 are tilted, upon allowing exhaust gases to flow thereto, an area at which the first side face 241 or the second side face 242 of the holding sealing material 240 is made in contact with the exhaust gases becomes greater. For this reason, the first side face 241 or the second side face 242 of the holding sealing material 240 tends to be easily subjected to wind erosion during the flowing of the exhaust gases. Moreover, the wind erosion generated on the first side face 241 or the second side face 242 of the holding sealing material 240 tends to progress to cause damages in the holding sealing material 240.

For this reason, in the case of a damage caused in the holding sealing material 240, it fails to sufficiently hold the exhaust gas treating body 230, as a result, a problem arises in that exhaust gases are leaked from a gap caused by the wind erosion, or in some cases, a problem arises in that the exhaust gas treating body 230 comes off.

In view of these problems, as an exhaust gas purifying apparatus forming an exhaust gas purifying system, for example, an exhaust gas purifying apparatus that uses a holding sealing material having a side face on which a slanting face is formed has been proposed, and a method for manufacturing such an exhaust gas purifying apparatus has also been proposed (JP-A 2007-092553).

The contents of JP-A 2007-092553 are incorporated herein by reference in their entirety.

SUMMARY OF THE INVENTION

According to one aspect of the present invention, an exhaust gas purifying system includes an exhaust gas purifying apparatus, an inlet pipe, and an exhaust pipe. The exhaust gas purifying apparatus has a first end portion and a second end portion opposite to the first end portion. The exhaust gas purifying apparatus includes a metal casing, an exhaust gas treating body, and a holding sealing material. The exhaust gas treating body is housed in the metal casing. The holding sealing material is wound around a peripheral portion of the exhaust gas treating body and is placed between the exhaust gas treating body and the metal casing. The inlet pipe is connected to the first end portion of the exhaust gas purifying apparatus so as to introduce exhaust gases into the exhaust gas purifying apparatus. The exhaust pipe is connected to the second end portion of the exhaust gas purifying apparatus so as to discharge the exhaust gases that have passed through the exhaust gas purifying apparatus. The exhaust gas purifying apparatus is provided with a gas inlet side connected to the inlet pipe and a gas outlet side connected to the exhaust pipe. The holding sealing material is formed into a mat shape containing inorganic fibers. The holding sealing material has a first side face and a second side face. The first side face is positioned on the gas outlet side of the exhaust gas purifying apparatus. The second side face is positioned on the gas inlet side of the exhaust gas purifying apparatus. The first side face of the holding sealing material has a first slanting face formed on the first side face. The first slanting face has a first inside end point and a first outside end point on a cross section in parallel with a longitudinal direction of the exhaust gas purifying apparatus. The holding sealing material contacts the exhaust gas treating body at the first inside end point on the cross section. The holding sealing material contacts the metal casing at the first outside end point on the cross section. The first inside end point is positioned between the gas inlet side of the exhaust gas purifying apparatus and the first outside end point. The first slanting face extends from the first inside end point to the first outside end point and is tilted relative to an end face of the exhaust gas treating body.

According to another aspect of the present invention, a method for manufacturing an exhaust gas purifying system includes stuffing an exhaust gas treating body with a holding sealing material being wound around a peripheral portion of the exhaust gas treating body into a metal casing so as to manufacture an exhaust gas purifying apparatus. The exhaust gas treating body around which the holding sealing material has been wound is pushed from a side of a first side face of the holding sealing material, with a second side face of the holding sealing material being allowed to form a leading portion relative to a proceeding direction of the stuffing. An inlet pipe is connected to a first end portion of the exhaust gas purifying apparatus to introduce exhaust gases into the exhaust gas purifying apparatus. The first end portion is closer to the second side face of the holding sealing material than to the first side face of the holding sealing material and is made to form a gas inlet side of the exhaust gas purifying apparatus. An exhaust pipe is connected to a second end portion of the exhaust gas purifying apparatus to discharge the exhaust gases that have passed through the exhaust gas purifying apparatus. The second end portion is closer to the first side face of the holding sealing material than to the second side face of the holding sealing material and is made to form a gas outlet side of the exhaust gas purifying apparatus. The exhaust gas purifying system includes the exhaust gas purifying apparatus, the inlet pipe, and the exhaust pipe. The exhaust gas purifying apparatus has the first end portion and the second end portion opposite to the first end portion. The exhaust gas purifying apparatus includes the metal casing, the exhaust gas treating body, and the holding sealing material. The exhaust gas treating body is housed in the metal casing. The holding sealing material is wound around the peripheral portion of the exhaust gas treating body and is placed between the exhaust gas treating body and the metal casing. The inlet pipe is connected to the first end portion of the exhaust gas purifying apparatus so as to introduce exhaust gases into the exhaust gas purifying apparatus. The exhaust pipe is connected to the second end portion of the exhaust gas purifying apparatus so as to discharge the exhaust gases that have passed through the exhaust gas purifying apparatus. The exhaust gas purifying apparatus is provided with the gas inlet side connected to the inlet pipe and the gas outlet side connected to the exhaust pipe. The holding sealing material is formed into a mat shape containing inorganic fibers. The holding sealing material has the first side face and the second side face. The first side face is positioned on the gas outlet side of the exhaust gas purifying apparatus. The second side face is positioned on the gas inlet side of the exhaust gas purifying apparatus. The first side face of the holding sealing material has a first slanting face formed on the first side face. The first slanting face has a first inside end point and a first outside end point on a cross section in parallel with a longitudinal direction of the exhaust gas purifying apparatus. The holding sealing material contacts the exhaust gas treating body at the first inside end point on the cross section. The holding sealing material contacts the metal casing at the first outside end point on the cross section. The first inside end point is positioned between the gas inlet side of the exhaust gas purifying apparatus and the first outside end point. The first slanting face extends from the first inside end point to the first outside end point and is tilted relative to an end face of the exhaust gas treating body.

According to further aspect of the present invention, a method for purifying exhaust gases using an exhaust gas purifying system includes introducing the exhaust gases discharged from an engine into an exhaust gas purifying apparatus of the exhaust gas purifying system through a gas inlet side of the exhaust gas purifying apparatus. The exhaust gases are discharged from a gas outlet side of the exhaust gas purifying apparatus. The exhaust gas purifying system includes the exhaust gas purifying apparatus, an inlet pipe, and an exhaust pipe. The exhaust gas purifying apparatus has a first end portion and a second end portion opposite to the first end portion. The exhaust gas purifying apparatus includes a metal casing, an exhaust gas treating body, and a holding sealing material. The exhaust gas treating body is housed in the metal casing. The holding sealing material is wound around a peripheral portion of the exhaust gas treating body and is placed between the exhaust gas treating body and the metal casing. The inlet pipe is connected to the first end portion of the exhaust gas purifying apparatus so as to introduce exhaust gases into the exhaust gas purifying apparatus. The exhaust pipe is connected to the second end portion of the exhaust gas purifying apparatus so as to discharge the exhaust gases that have passed through the exhaust gas purifying apparatus. The exhaust gas purifying apparatus is provided with the gas inlet side connected to the inlet pipe and the gas outlet side connected to the exhaust pipe. The holding sealing material is formed into a mat shape containing inorganic fibers. The holding sealing material has a first side face and a second side face. The first side face is positioned on the gas outlet side of the exhaust gas purifying apparatus. The second side face is positioned on the gas inlet side of the exhaust gas purifying apparatus. The first side face of the holding sealing material has a first slanting face formed on the first side face. The first slanting face has a first inside end point and a first outside end point on a cross section in parallel with a longitudinal direction of the exhaust gas purifying apparatus. The holding sealing material contacts the exhaust gas treating body at the first inside end point on the cross section. The holding sealing material contacts the metal casing at the first outside end point on the cross section. The first inside end point is positioned between the gas inlet side of the exhaust gas purifying apparatus and the first outside end point. The first slanting face extends from the first inside end point to the first outside end point and is tilted relative to an end face of the exhaust gas treating body.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
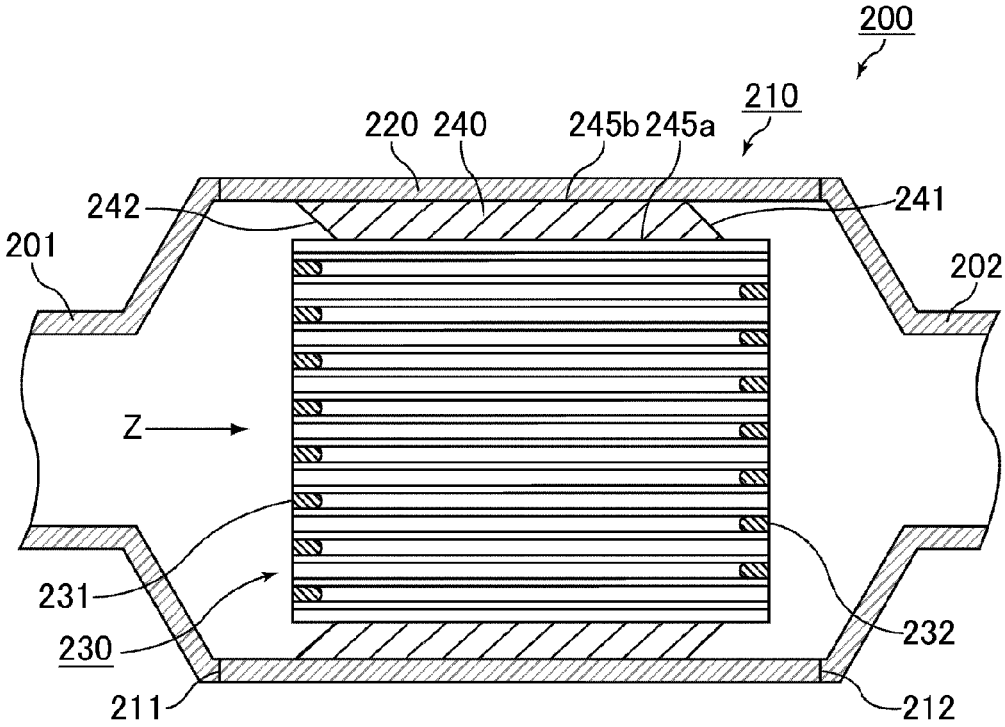
FIG. 1 is a cross-sectional view that schematically illustrates an example of a conventional exhaust gas purifying system.

The embodiments will now be described with reference to the accompanying drawings, wherein like reference numerals designate corresponding or identical elements throughout the various drawings.

In a holding sealing material to be used in the exhaust gas purifying apparatus described in JP-A 2007-092553, first, the side face of the holding sealing material is cut by using a cutting tool, such as a cutter, to form a slanting face that is tilted from a first main face side to a second main face side. Next, the holding sealing material is wound around the peripheral portion of the exhaust gas treating body as a single layer so that a wound body is manufactured, with this side face (slanting face) of the holding sealing material protruding in a stuffing direction at the time when the wound body is stuffed to the metal casing.

In the case when the wound body thus manufactured is stuffed to the metal casing, it is considered that as the second main face and the proximity thereof are deformed in a direction opposite to the stuffing direction, the slanting face is gradually made in parallel with the end face of the exhaust gas treating body. Moreover, in a state where the wound body is disposed at a predetermined position, the second side face of the holding sealing material is supposed to be made just substantially in parallel with the end face of the exhaust gas treating body.

However, in the case when an exhaust gas purifying system is manufactured through a conventional method by using the exhaust gas purifying apparatus described in JP-A 2007-092553, upon allowing exhaust gases to flow into the exhaust gas purifying system, the exhaust gas treating body is pushed toward the gas outlet side in response to the flowing exhaust gases.

Figure 2A:
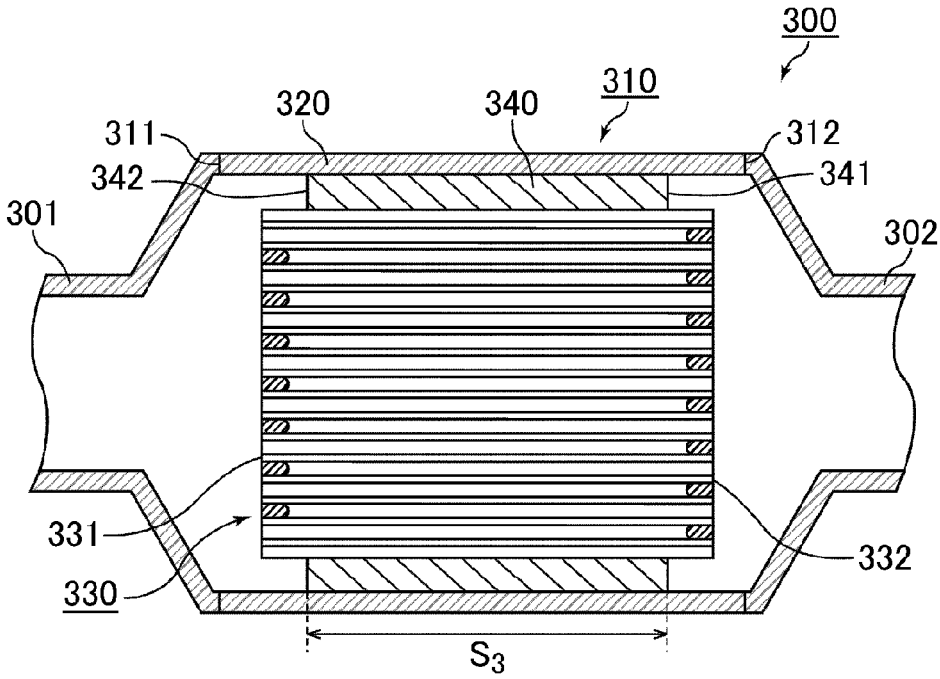
FIG. 2A is a cross-sectional view that schematically illustrates another example of a conventional exhaust-gas purifying system prior to allowing exhaust gases to flow therein.
Figure 2B:
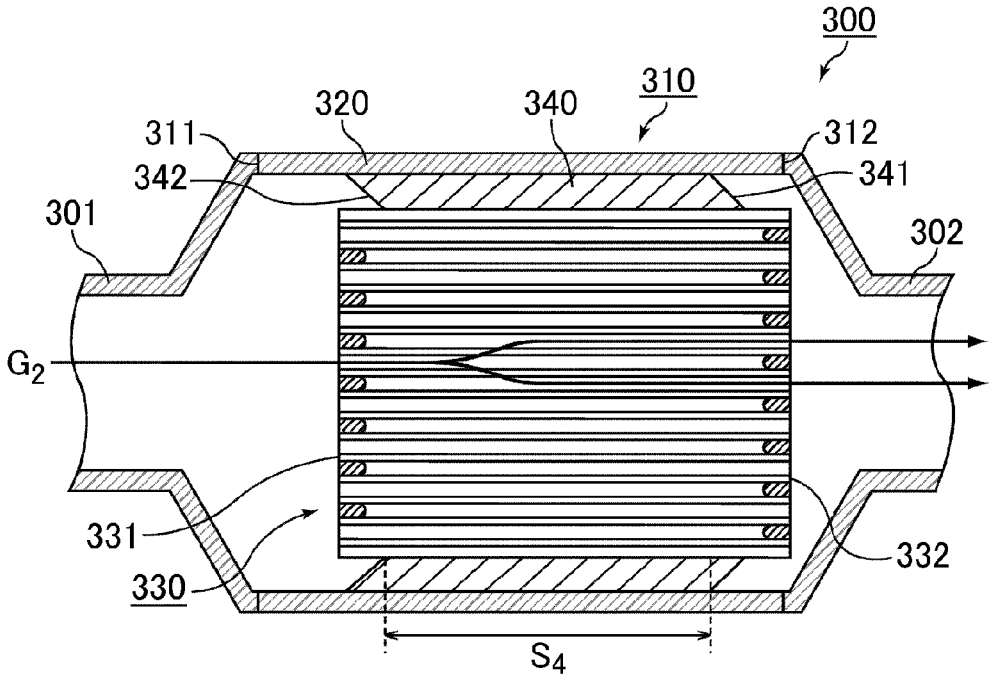
BACKGROUND ART FIG.2B
FIG. 2B is a cross-sectional view that schematically illustrates another example of a conventional exhaust gas purifying system with exhaust gases flowing thereto.

FIG. 2A is a cross-sectional view that schematically illustrates another example of a conventional exhaust gas purifying system prior to allowing exhaust gases to flow therein, and FIG. 2B is a cross-sectional view that schematically illustrates another example of a conventional exhaust gas purifying system with exhaust gases flowing thereto.

An exhaust gas purifying system 300, shown in FIG. 2A and FIG. 2B, is manufactured through a conventional method by using the exhaust gas purifying apparatus described in JP-A 2007-092553.

When exhaust gases $G_2$ are allowed to flow into the exhaust gas purifying system 300, as shown in FIG. 2B, a first side face 341 and a second side face 342 of a holding sealing material 340 are brought into a tilted state.

In the case when the side faces of the holding sealing material are kept in a tilted state, in the same manner as in a conventional exhaust gas purifying system, a problem arises in that the holding sealing material is easily subjected to wind erosion. In addition to the problem of wind erosion of the holding sealing material, the following problems are also raised.

When viewed on a cross section in parallel with a longitudinal direction of the exhaust gas purifying apparatus, the gap between the exhaust gas treating body and the metal casing is completely filled with the holding sealing material at a portion where the first side face or the second side face of the holding sealing material is not tilted. In the portion where the gap between the exhaust gas treating body and the metal casing is completely filled with the holding sealing material, the holding sealing material can push out the exhaust gas treating body and the metal casing perpendicularly. As a result, a facial pressure (pressure applied to the holding face of the holding sealing material) is generated on the holding sealing material.

On the other hand, at a portion where the first side face or the second side face of the holding sealing material is tilted, there is a space where the gap between the exhaust gas treating body and the metal casing is not filled with the holding sealing material. Since, at the portion where the first side face or the second side face of the holding sealing material is tilted, there is no holding sealing material in the gap between the exhaust gas treating body and the metal casing, the holding sealing material is not allowed to push out the exhaust gas treating body and the metal casing perpendicularly. As a result, no facial pressure is generated on the holding sealing material.

In the following description, the area at which a facial pressure is generated is referred to as "facial pressure effective area".

In an exhaust gas purifying system 300 shown in FIG. 2A prior to allowing exhaust gases to flow therein, the facial pressure effective area corresponds to an area of a portion indicated by "$S_3$". On the other hand, in an exhaust gas purifying system 300 shown in FIG. 2B with exhaust gases flowing thereto, the facial pressure effective area corresponds to an area of a portion indicated by "$S_4$".

Upon allowing exhaust gases $G_2$ to flow into the exhaust gas purifying system 300, a first side face 341 and a second side face 342 of the holding sealing material 340 are gradually tilted, with the result that the facial pressure effective area is reduced from $S_3$ to $S_4$. Consequently, the holding strength of the holding sealing material tends to be lowered.

In this manner, in the case when an exhaust gas purifying system is manufactured through a conventional method by using an exhaust gas purifying apparatus described in JP-A 2007-092553, the holding strength of the holding sealing material tends to be lowered during flowing of exhaust gases, resulting in a problem in that the holding sealing material tends not to sufficiently hold the exhaust gas treating body.

Embodiments of the present invention make it possible to provide an exhaust gas purifying system including an exhaust gas purifying apparatus that tends to allow the holding sealing material to sufficiently hold the exhaust gas treating body even during flowing of exhaust gases, as well as a method for manufacturing such an exhaust gas purifying system and an exhaust gas purifying method in which the exhaust gas purifying system is used.

That is, an exhaust gas purifying system according to embodiments of the present invention includes:

an exhaust gas purifying apparatus that includes a metal casing, an exhaust gas treating body housed in the metal casing, and a holding sealing material that is wound around a peripheral portion of the exhaust gas treating body, and is placed between the exhaust gas treating body and the metal casing;

an inlet pipe that is connected to one of ends of the exhaust gas purifying apparatus so as to introduce exhaust gases into the exhaust gas purifying apparatus; and an exhaust pipe that is connected to the other end of the exhaust gas purifying apparatus so as to discharge the exhaust gases that have passed through the exhaust gas purifying apparatus outside, wherein the exhaust gas purifying apparatus is provided with a gas inlet side connected to the inlet pipe and a gas outlet side connected to the exhaust pipe, the holding sealing material, which is formed into a mat shape containing inorganic fibers, has a first side face positioned on the gas outlet side of the exhaust gas purifying apparatus and a second side face positioned on the gas inlet side of the exhaust gas purifying apparatus, with the first side face of the holding sealing material having a first slanting face formed thereon, on a cross section in parallel with a longitudinal direction of the exhaust gas purifying apparatus, the first slanting face has a first inside end point at which the holding sealing material and the exhaust gas treating body are made in contact with each other and a first outside end point at which the holding sealing material and the metal casing are made in contact with each other, the first inside end point is positioned closer to the gas inlet side of the exhaust gas purifying apparatus than the first outside end point, and the first slanting face is directed to the first outside end point from the first inside end point, with the first slanting face being tilted relative to an end face of the exhaust gas treating body.

In the exhaust gas purifying system according to the embodiments of the present invention, the first side face of the holding sealing material is tilted in a direction reversed to that of an exhaust gas purifying system produced by a conventional method.

In the case when exhaust gases are allowed to flow into the exhaust gas purifying system according to the embodiments of the present invention, the exhaust gas treating body is pushed toward a gas outlet side of the exhaust gas purifying apparatus in response to the flowing of the exhaust gases. As a result, a first slanting face formed on the first side face of the holding sealing material is shifted in a flowing direction of the exhaust gases that is, toward the gas outlet side of the exhaust gas purifying apparatus, so that the first side face tends to be gradually made to be substantially in parallel with the end face of the exhaust gas treating body.

In the exhaust gas purifying system according to the embodiments of the present invention, different from an exhaust gas purifying system manufactured by a conventional method, a sufficient facial pressure is more easily generated relative to the exhaust gas treating body and the metal casing. As a result, since the holding strength of the holding sealing material is more likely to be prevented from being lowered even during flowing of exhaust gases, the holding sealing material tends to sufficiently hold the exhaust gas treating body.

Figure 3A:
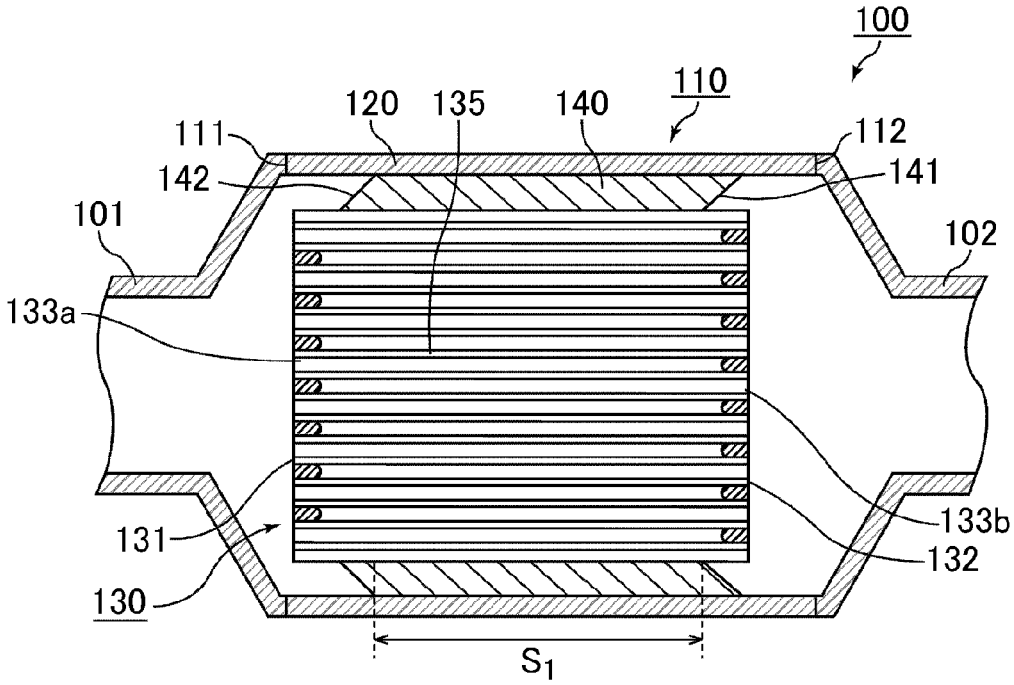
FIG. 3A is a cross-sectional view that schematically illustrates an example of an exhaust gas purifying system according to one embodiment of the present invention prior to allowing exhaust gases to flow therein.
Figure 3B:
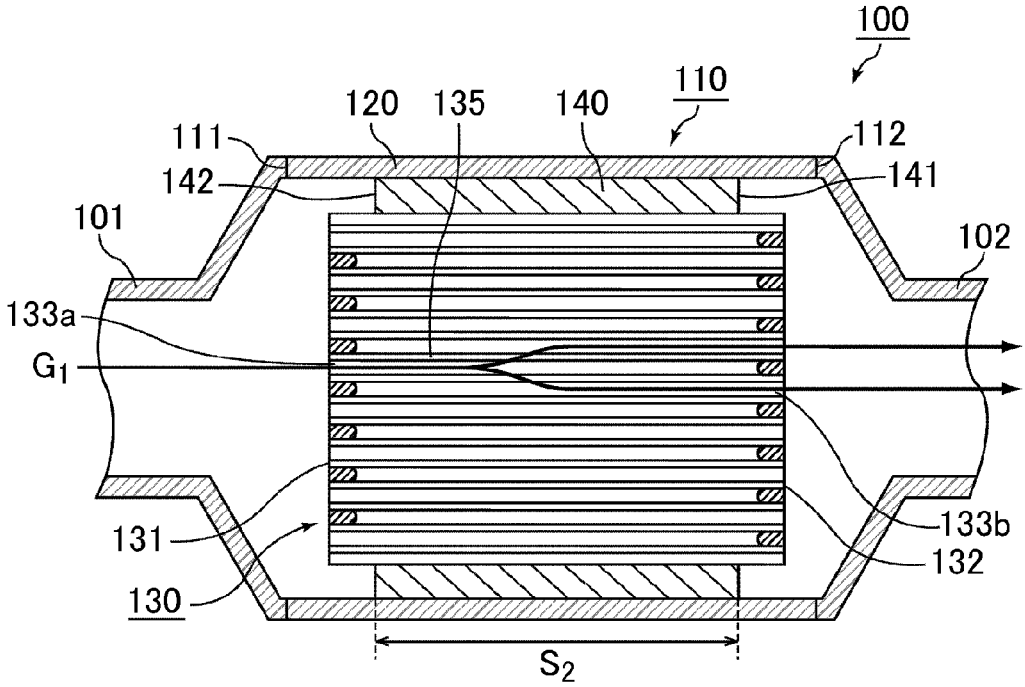
FIG. 3B is a cross-sectional view that schematically illustrates an example of the exhaust gas purifying system according to one embodiment of the present invention during flowing of the exhaust gases.

In the exhaust gas purifying system according to the embodiments of the present invention, the reason that the holding strength of the holding sealing material is less likely to be lowered even during flowing of exhaust gases is presumably explained as follows:

FIG. 3A is a cross-sectional view that schematically illustrates one example of an exhaust gas purifying system according to one embodiment of the present invention prior to allowing exhaust gases to flow therein. FIG. 3B is a cross-sectional view that schematically illustrates one example of the exhaust gas purifying system according to one embodiment of the present invention during flowing of exhaust gases;

In the exhaust gas purifying system 100 prior to allowing exhaust gases to flow therein shown in FIG. 3A, a facial pressure effective area in which a facial pressure is generated corresponds to an area indicated by "$S_1$". On the other hand, in the exhaust gas purifying system 100 during flowing of exhaust gases, shown in FIG. 3B, the facial pressure effective area corresponds to an area indicated by "$S_2$"; and In the case when exhaust gases $G_1$ are allowed to flow into the exhaust gas purifying system 100, since a first side face 141 of a holding sealing material 140 tends to gradually made substantially in parallel with the end face of an exhaust gas treating body 130, the facial pressure effective area tends to increase from $S_1$ to $S_2$. As a result, the holding strength of the holding sealing material tends to increase.

Moreover, in the exhaust gas purifying system according to the embodiments of the present invention, since the holding sealing material forming the exhaust gas purifying apparatus is more likely to exert sufficient holding strength, it may be easier to reduce a gap bulk density (GBD) of the holding sealing material to be placed between the exhaust gas treating body and the metal casing. As a result, the amount of the holding sealing material forming the exhaust gas purifying apparatus is more likely to be reduced.

Additionally, the gap bulk density (GBD) of the holding sealing material refers to a bulk density of the holding sealing material after the wound body has been stuffed to the metal casing, and can be found from an equation: "[Gap bulk density ($g/cm^3$)]=[Weight ($g/cm^2$) of the holding sealing material per unit area]/[Distance (cm) of gap between the exhaust gas treating body and the metal casing]".

Moreover, in a conventional exhaust gas purifying system, since the holding strength of the holding sealing material forming the exhaust gas purifying apparatus is not sufficient, it is difficult to sufficiently hold the exhaust gas treating body by using only the holding sealing material. Consequently, it is necessary to use another holding material, such as metal net, in order to hold the exhaust gas treating body. However, in the exhaust gas purifying system according to the embodiments of the present invention, since the exhaust gas treating body tends to be sufficiently held by using only the holding sealing material, the use of another holding material such as a metal net tends to be omitted.

Furthermore, in the case when the first side face of the holding sealing material is tilted in a direction reversed to that of the exhaust gas purifying system manufactured by a conventional method, as in the case of the exhaust gas purifying system according to the embodiments of the present invention, the amount of scattered inorganic fibers forming the holding sealing material from the gas inlet side of the exhaust gas purifying apparatus toward an internal combustion engine is more likely to be reduced.

Although the reason for this has not been clarified, the effect is considered to be derived from the fact that in the exhaust gas purifying system according to the embodiments of the present invention, the inorganic fibers tend to be constrained by the holding strength of the holding sealing material forming the exhaust gas purifying apparatus.

In the exhaust gas purifying system according to the embodiments of the present invention, a second slanting face is preferably formed on the second side face of the holding sealing material, on a cross section in parallel with a longitudinal direction of the exhaust gas purifying apparatus, the second slanting face has a second inside end point at which the holding sealing material and the exhaust gas treating body are made in contact with each other and a second outside end point at which the holding sealing material and the metal casing are made in contact with each other, the second inside end point is preferably positioned closer to the gas inlet side of the exhaust gas purifying apparatus than the second outside end point, and the second slanting face is preferably directed to the second outside end point from the second inside end point, with the second slanting face being tilted relative to an end face of the exhaust gas treating body.

In the exhaust gas purifying system according to the embodiments of the present invention, in addition to that on the first side face of the holding sealing material, a slanting face is also preferably formed on the second side face of the holding sealing material. The second side face of the holding sealing material is preferably tilted in a direction reversed to that in the exhaust gas purifying system manufactured by a conventional method.

In the case when exhaust gases are allowed to flow into the exhaust gas purifying system in which the slanting face is also formed on the second side face of the holding sealing material, since the second slanting face formed on the second side face of the holding sealing material is shifted in a flowing direction of the exhaust gases, that is, toward the gas outlet side of the exhaust gas purifying apparatus, so that not only the first side face of the holding sealing material, but also the second side face of the holding sealing material tends to be gradually made substantially in parallel with the end face of an exhaust gas treating body.

In the case when exhaust gases are allowed to flow into the exhaust gas purifying system in which the slanting face is also formed on the second side face of the holding sealing material, since the first side face and the second side face of the holding sealing material tend to be gradually made substantially in parallel with the end face of an exhaust gas treating body, the facial pressure effective area tends to increase. As a result, the holding strength of the holding sealing material tends to be improved. In this manner, different from an exhaust gas purifying system manufactured by using a conventional method, the exhaust gas purifying system in which the slanting face is also formed on the second side face of the holding sealing material is more likely to increase the facial pressure relative to the exhaust gas treating body and the metal casing. As a result, the holding sealing material forming the exhaust gas purifying apparatus is more likely to exert a greater holding strength than that of the holding sealing material in the exhaust gas purifying apparatus forming the exhaust gas purifying system in which the slanting face is formed on the first side face of the holding sealing material.

In the exhaust gas purifying system according to the embodiments of the present invention, on a cross section in parallel with a longitudinal direction of the exhaust gas purifying apparatus, a first angle formed by a line segment connecting the first inside end point to the first outside end point and an inner circumference of the metal casing is preferably from about 25° to about 89.5°.

In the case when the first angle is about 25° or higher, since the deformation of the holding sealing material in the exhaust gas purifying apparatus tends not to become too large, the holding sealing material tends not to be easily damaged. Moreover, in the case when the first angle is about 25° or higher, since the facial pressure effective area tends not to become too small in the exhaust gas purifying system prior to allowing exhaust gases to flow therein, the holding sealing material tends to exert a sufficient holding strength.

In contrast, when the first angle is about 89.5° or smaller, the effect of the installation of the first slanting face on the holding sealing material in the exhaust gas purifying apparatus tends to be sufficiently obtained.

In the exhaust gas purifying system according to the embodiments of the present invention, the holding sealing material preferably has a plurality of needle marks formed by a needling treatment.

In the case when the needle marks are formed on the holding sealing material forming the exhaust gas purifying apparatus, upon stuffing the wound body into the metal casing, the needle marks of the holding sealing material tends to exert a predetermined directivity. When the predetermined directivity is exerted by the holding sealing material in the exhaust gas purifying apparatus, the push-out intensity applied to the exhaust gas treating body and the metal casing by the holding sealing material tends to be increased so that it is considered that the holding strength of the holding sealing material is more likely to be improved.

The reason that the holding sealing material having the needle marks exerts greater holding strength is explained as follows:

When the holding sealing material includes inorganic fibers, the inorganic fibers tend to be aligned in a direction perpendicular to the surface of the holding sealing material in the needle marks. As a result, in the exhaust gas purifying apparatus, the push-out intensity applied to the exhaust gas treating body and the metal casing in the direction of the needle marks (aligned direction of the inorganic fibers) by the holding sealing material presumably tends to increase.

In the exhaust gas purifying system according to the embodiments of the present invention, the plurality of needle marks are preferably formed in a direction diagonal to the thickness direction of the holding sealing material.

In the exhaust gas purifying apparatus, in the case when the plurality of needle marks are formed in a direction diagonal to the thickness direction of the holding sealing material, since the push-out intensity applied to the exhaust gas treating body and the metal casing by the holding sealing material tends to become greater, the holding strength of the holding sealing material presumably tends to be further improved.

In the exhaust gas purifying system according to the embodiments of the present invention, a binder is preferably applied to the holding sealing material.

By the binder applied to the holding sealing material, the inorganic fibers forming the holding sealing material are more likely to be mutually anchored. Therefore, when the binder is applied to the holding sealing material forming the exhaust gas purifying apparatus, the direction of the needle marks can be easily maintained. For this reason, in the exhaust gas purifying apparatus, the push-out intensity applied to the exhaust treating body and the metal casing by the holding sealing material tends to become greater. As a result, the holding strength of the holding sealing material in the exhaust gas purifying apparatus presumably tends to be improved.

In the exhaust gas purifying system according to the embodiments of the present invention, the binder applied to the holding sealing material presumably has an amount of about 10% by weight or less.

In the case when a binder is applied to the holding sealing material forming the exhaust gas purifying apparatus as described above, the holding strength of the holding sealing material in the exhaust gas purifying apparatus tends to be improved. However, as the amount of the binder applied to the holding sealing material increases, the effect of improving the holding strength of the holding sealing material tends to become smaller; therefore, the amount of the binder to be applied to the holding sealing material is preferably set to about 10% by weight or less. When the amount of the binder applied to the holding sealing material is about 10% by weight or less, the inorganic fibers forming the holding sealing material tend not to be mutually anchored firmly. As a result, since the elasticity possessed by the inorganic fibers forming the holding sealing material tends not to become weaker, the effect of improving the holding strength of the holding sealing material presumably tends not to be reduced. Moreover, when the amount of the binder applied to the holding sealing material is about 10% by weight or less, the binder components are thermally decomposed with the result that a problem tends not to arise in that much decomposed gas is generated.

In the exhaust gas purifying system according to the embodiments of the present invention, the metal casing preferably has a distinguished gas inlet side forming the gas inlet side of the exhaust gas purifying apparatus and a distinguished gas outlet side forming the gas outlet side of the exhaust gas purifying apparatus.

In this manner, in the exhaust gas purifying system according to the embodiments of the present invention, the gas inlet side and the gas outlet side of the metal casing forming the exhaust gas purifying apparatus may be distinguished from each other, or the gas inlet side and the gas outlet side of the metal casing may not be distinguished from each other.

In any of the cases, the exhaust gas purifying apparatus forming the exhaust gas purifying system has a gas inlet side connected to the inlet pipe and a gas outlet side connected to the exhaust pipe.

A method for manufacturing an exhaust gas purifying system according to the embodiments of the present invention, which is a method for manufacturing the above exhaust gas purifying system, includes:

stuffing the exhaust gas treating body with the holding sealing material being wound around the peripheral portion thereof into a metal casing so as to manufacture the exhaust gas purifying apparatus; and connecting the inlet pipe for introducing exhaust gases into the exhaust gas purifying apparatus to one of ends of the exhaust gas purifying apparatus, and also connecting the exhaust pipe for discharging the exhaust gases that have passed through the exhaust gas purifying apparatus outside to the other end of exhaust gas purifying apparatus, wherein in the stuffing of the exhaust gas treating body with the holding sealing material, the exhaust gas treating body around which the holding sealing material has been wound is pushed from the first side face side of the holding sealing material, with the second side face of the holding sealing material being allowed to form a leading portion relative to a proceeding direction of the stuffing, and in the connecting of the inlet pipe and the connecting of the exhaust pipe, of end portions of the exhaust gas purifying apparatus, the inlet pipe is connected to an end portion closer to the second side face of the holding sealing material than to the first side face of the holding sealing material, with the exhaust pipe being connected to another end portion closer to the first side face of the holding sealing material than to the second side face of the holding sealing material so that the end portion closer to the second side face of the holding sealing material than to the first side face of the holding sealing material is made to form the gas inlet side of the exhaust gas purifying apparatus, while the end portion closer to the first side face of the holding sealing material than to the second side face of the holding sealing material is made to form the gas outlet side of the exhaust gas purifying apparatus.

In the method for manufacturing the exhaust gas purifying system according to the embodiments of the present invention, without the necessity of carrying out a cutting process on the side face of the holding sealing material by a cutting tool such as a cutter each time, the first slanting face tends to be formed on the first side face of the holding sealing material, and the second slanting face tends to be formed on the second side face of the holding sealing material. For this reason, the exhaust gas purifying system according to the embodiments of the present invention, provided with the exhaust gas purifying apparatus that more easily allows the holding sealing material to exert sufficient holding strength, may be more easily manufactured easily and efficiently.

Moreover, in the exhaust gas purifying apparatus having the holding sealing material on which the first slanting face is formed, the gap bulk density (GBD) of the holding sealing material placed between the exhaust gas treating body and the metal casing tends to be made smaller so that in the method for manufacturing the exhaust gas purifying system according to the embodiments of the present invention, the exhaust gas purifying apparatus may be more easily manufactured by using a small amount of the holding sealing material, and the exhaust gas purifying system may be more easily manufactured by using the exhaust gas purifying apparatus.

Moreover, in the method for manufacturing the exhaust gas purifying system according to the embodiments of the present invention, it may be easier to manufacture an exhaust gas purifying apparatus that tends to sufficiently hold the exhaust gas treating body by using only the holding sealing material, without the necessity of using another holding material such as a metal net, and the exhaust gas purifying system may be more easily produced by using the exhaust gas purifying apparatus.

In the method for manufacturing the exhaust gas purifying system according to the embodiments of the present invention, the metal casing preferably has a distinguished gas inlet side forming the gas inlet side of the exhaust gas purifying apparatus and a distinguished gas outlet side forming the gas outlet side of the exhaust gas purifying apparatus, and the method preferably further includes, prior to the stuffing of the exhaust gas treating body with the holding sealing material, arranging the exhaust gas treating body around which the holding sealing material has been wound, with the second side face of the holding sealing material being allowed to form a leading portion relative to a proceeding direction of the stuffing, so that the first side face of the holding sealing material is positioned on the gas outlet side of the metal casing and the second side face of the holding sealing material is positioned on the gas inlet side of the metal casing.

In the case when the metal casing forming the exhaust gas purifying apparatus has distinguished gas inlet side and gas outlet side, by determining a direction in which the wound body is stuffed into the metal casing, prior to the stuffing of the exhaust gas treating body with the holding sealing material, an exhaust gas purifying apparatus having the first slanting face formed on the first side face of the holding sealing material and the second slanting face formed on the second side face of the holding sealing material may be more easily manufactured, and the exhaust gas purifying system may be more easily manufactured by using the exhaust gas purifying apparatus.

An exhaust gas purifying method according to the embodiments of the present invention, which is a method for purifying exhaust gases discharged from an engine by using the above exhaust gas purifying system, includes:

allowing exhaust gases discharged from the engine to flow into the exhaust gas purifying apparatus through the gas inlet side of the exhaust gas purifying apparatus and also to flow out of the exhaust gas purifying apparatus from the gas outlet side.

In the case when exhaust gases are allowed to flow through the exhaust gas purifying system according to the embodiments of the present invention in the direction described above, since the exhaust gas treating body is pressed toward the gas outlet side of the exhaust gas purifying apparatus, the first side face of the holding sealing material tends to be gradually made substantially in parallel with the end face of the exhaust gas treating body. As a result, since the facial pressure effective area tends to be increased, the holding strength of the holding sealing material is more likely to be prevented from being lowered even during flowing of exhaust gases.

First Embodiment

Hereinafter, a description is given with reference to the drawings on a first embodiment which is one embodiment of an exhaust gas purifying system of the present invention, a method for manufacturing such an exhaust gas purifying system, and an exhaust gas purifying method using the exhaust gas purifying system.

First, the following description will discuss an exhaust gas purifying system in accordance with one embodiment of the present invention.

Figure 4:
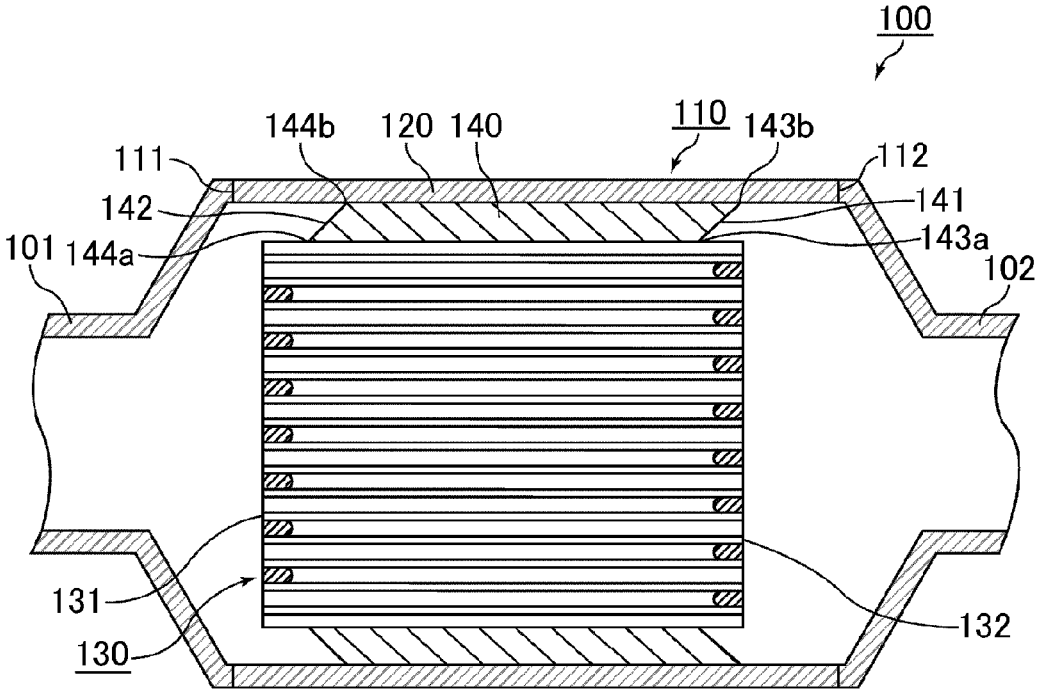
FIG. 4 is a cross-sectional view that schematically illustrates an example of an exhaust gas purifying system in accordance with a first embodiment of the present invention.

FIG. 4 is a cross-sectional view that schematically illustrates an example of an exhaust gas purifying system of the first embodiment of the present invention.

The exhaust gas purifying system 100 shown in FIG. 4 includes: an exhaust gas purifying apparatus 110; an inlet pipe 101 that is connected to one of ends of the exhaust gas purifying apparatus 110, and used for introducing exhaust gases into the exhaust gas purifying apparatus 110; and an exhaust pipe 102 that is connected to the other end of the exhaust gas purifying apparatus 110, and used for discharging the exhaust gases that have passed through the exhaust gas purifying apparatus 110 outside.

The exhaust gas purifying apparatus 110 is provided with a gas inlet side 111 connected to the inlet pipe 101 and a gas outlet side 112 connected to the exhaust pipe 102.

Figure 5A:
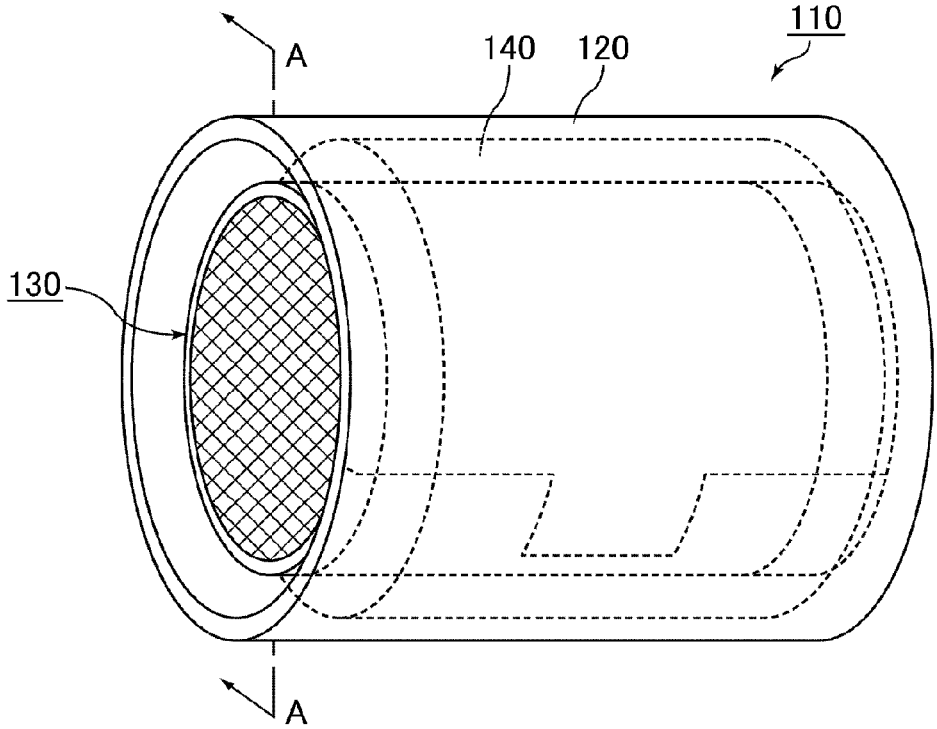
FIG. 5A is a perspective view that schematically illustrates an example of an exhaust gas purifying apparatus forming the exhaust gas purifying system of the first embodiment of the present invention.
Figure 5B:
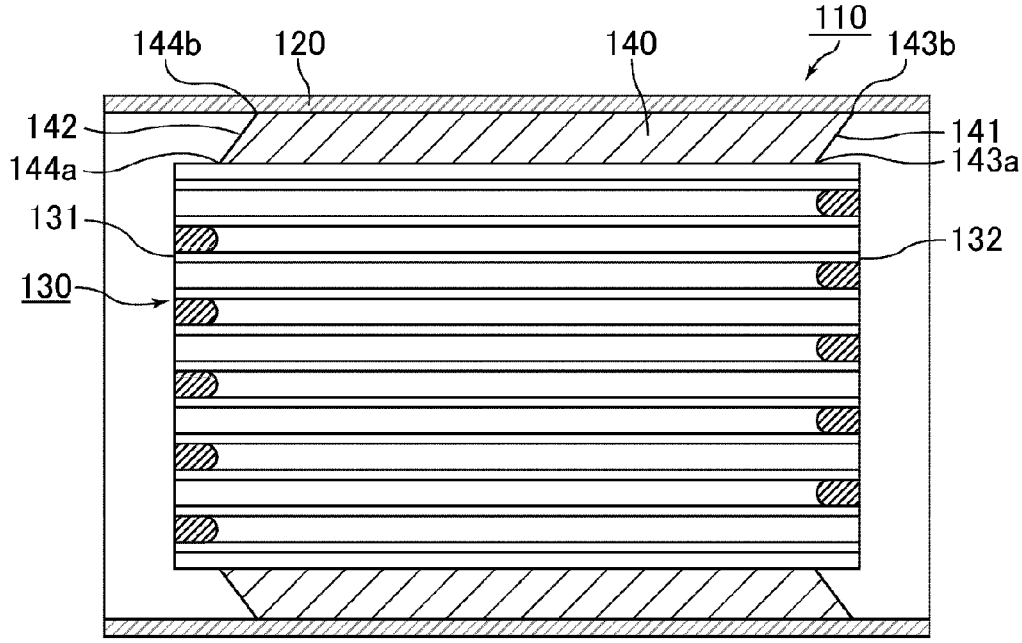
FIG. 5B is an A-A line cross-sectional view of the exhaust gas purifying apparatus shown in FIG. 5A.

FIG. 5A is a perspective view that schematically illustrates an example of the exhaust gas purifying apparatus forming an exhaust gas purifying system in accordance with the first embodiment of the present invention. FIG. 5B is an A-A line cross-sectional view of the exhaust gas purifying apparatus shown in FIG. 5A.

The exhaust gas purifying apparatus 110, shown in FIG. 5A and FIG. 5B, is provided with a metal casing 120, an exhaust gas treating body 130 housed in the metal casing 120, and a holding sealing material 140 that is placed between the exhaust gas treating body 130 and the metal casing 120.

The holding sealing material 140 is a mat-shaped member containing inorganic fibers, and wound around the periphery of the exhaust gas treating body 130. Thus, the exhaust gas treating body 130 is held by the holding sealing material 140.

In the exhaust gas purifying system 100 shown in FIG. 4, the exhaust gas treating body 130 forming the exhaust gas purifying apparatus 110 is provided with an inlet-side end face 131 positioned on the gas inlet side 111 of the exhaust gas purifying apparatus 110 and an outlet-side end face 132 positioned on the gas outlet side 112 of the exhaust gas purifying apparatus 110.

The following description will discuss the holding sealing material in the exhaust gas purifying apparatus forming the exhaust gas purifying system of the present embodiment.

As shown in FIG. 4, in the exhaust gas purifying apparatus 110 forming the exhaust gas purifying system 100, the holding sealing material 140 is provided with a first side face 141 positioned on the gas outlet side 112 of the exhaust gas purifying apparatus 110 and a second side face 142 positioned on the gas inlet side 111 of the exhaust gas purifying apparatus 110. Moreover, on the first side face 141 of the holding sealing material 140, a first slanting face is formed, and on the second side face 142 of the holding sealing material 140, a second slanting face is formed.

The first slanting face formed on the first side face 141 of the holding sealing material 140 has a first inside end point 143*a* at which the holding sealing material 140 and the exhaust gas treating body 130 are made in contact with each other, and a first outside end point 143*b* at which the holding sealing material 140 and the metal casing 120 are made in contact with each other.

The first inside end point 143*a* of the holding sealing material 140 is positioned closer the gas inlet side 111 of the exhaust gas purifying apparatus 110 than the first outside end point 143*b* of the holding sealing material 140. Moreover, the first slanting face is tilted relative to the end face of the exhaust gas treating body 130, and directed toward the first outside end point 143*b* from the first inside end point 143*a*.

The second slanting face formed on the second side face 142 of the holding sealing material 140 has a second inside end point 144*a* at which the holding sealing material 140 and the exhaust gas treating body 130 are made in contact with each other, and a second outside end point 144*b* at which the holding sealing material 140 and the metal casing 120 are made in contact with each other.

The second inside end point 144*a* of the holding sealing material 140 is positioned closer the gas inlet side 111 of the exhaust gas purifying apparatus 110 than the second outside end point 144*b* of the holding sealing material 140. Moreover, the second slanting face is tilted relative to the end face of the exhaust gas treating body 130, and directed toward the second outside end point 144*b* from the second inside end point 144*a*.

Figure 6:
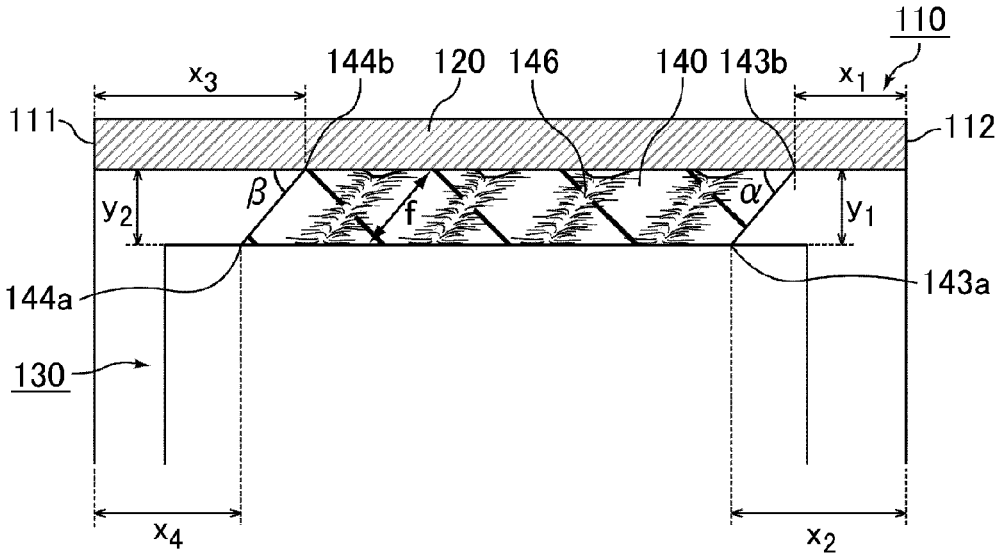
FIG. 6 is a partially enlarged cross-sectional view that illustrates a portion in proximity to an inner circumference of a metal casing in the exhaust gas purifying apparatus forming the exhaust gas purifying system shown in FIG. 4.

FIG. 6 is a partially enlarged cross-sectional view that illustrates a portion in proximity to an inner circumference of a metal casing in the exhaust gas purifying apparatus forming the exhaust gas purifying system shown in FIG. 4.

In the present description, on a cross section in parallel with the longitudinal direction of the exhaust gas purifying apparatus, of angles formed by a line segment connecting a first inside end point to a first outside end point and the inner circumference of the metal casing, an angle corresponding to an acute angle is referred to as "a first angle". Moreover, on a cross section in parallel with the longitudinal direction of the exhaust gas purifying apparatus, of angles formed by a line segment connecting a second inside end point to a second outside end point and the inner circumference of the metal casing, an angle corresponding to an acute angle is referred to as "a second angle".

That is, in the exhaust gas purifying apparatus 110 shown in FIG. 6, the angle indicated by "α" is the first angle, and the angle indicated by "β" is the second angle.

Referring to FIG. 6, the following description will discuss how to find the first angle.

First, a distance from the gas outlet side 112 of the exhaust gas purifying apparatus 110 to the first outside end point 143*b* of the holding sealing material 140 (length of a double-headed arrow "$x_1$" in FIG. 6) is measured. Next, a distance from the gas outlet side 112 of the exhaust gas purifying apparatus 110 to the first inside end point 143*a* of the holding sealing material 140 (length of a double-headed arrow "$x_2$" in FIG. 6) is measured. Moreover, a distance between the metal casing 120 and the exhaust gas treating body 130 (length of a double-headed arrow "$y_1$" in FIG. 6) is measured. Then, based upon the following equation (1), the first angle α is calculated. In the equation (1), "arctan" represents inverse tangent (inverse function of tangent).

$$\text{First angle } \alpha(°)=\arctan\,[y_1/(x_2-x_1)] \quad (1)$$

The second angle can be found in the same manner as in the first angle. That is, in FIG. 6, a distance "$x_3$" from the gas inlet side 111 of the exhaust gas purifying apparatus 110 to the second outside end point 144*b* of the holding sealing material 140, a distance "$x_4$" from the gas inlet side 111 of the exhaust gas purifying apparatus 110 to the second inside end point 144*a* of the holding sealing material 140, and a distance "$y_2$" between the metal casing 120 and the exhaust gas treating body 130 are respectively measured, and based upon the following equation (2), the second angle β is calculated.

$$\text{Second angle } \beta(°)=\arctan\,[y_2/(x_3-x_4)] \quad (2)$$

In the exhaust gas purifying system of the present embodiment, the first angle (on the cross section in parallel with the longitudinal direction of the exhaust gas purifying apparatus, of angles formed by a line segment connecting a first inside end point to a first outside end point and the inner circumference of the metal casing, the angle corresponding to an acute angle) is preferably set in the range of about 25° to about 89.5° from the viewpoint of holding strength of the holding sealing material.

Moreover, in the exhaust gas purifying system of the present embodiment, the second angle (on the cross section in parallel with the longitudinal direction of the exhaust gas purifying apparatus, of angles formed by a line segment connecting a second inside end point to a second outside end point and the inner circumference of the metal casing, an angle corresponding to an acute angle) is preferably set in the range of about 25° to about 89.5° from the viewpoint of holding strength of the holding sealing material.

The following description will discuss an example of a structure of the holding sealing material in detail.

Figure 7A:
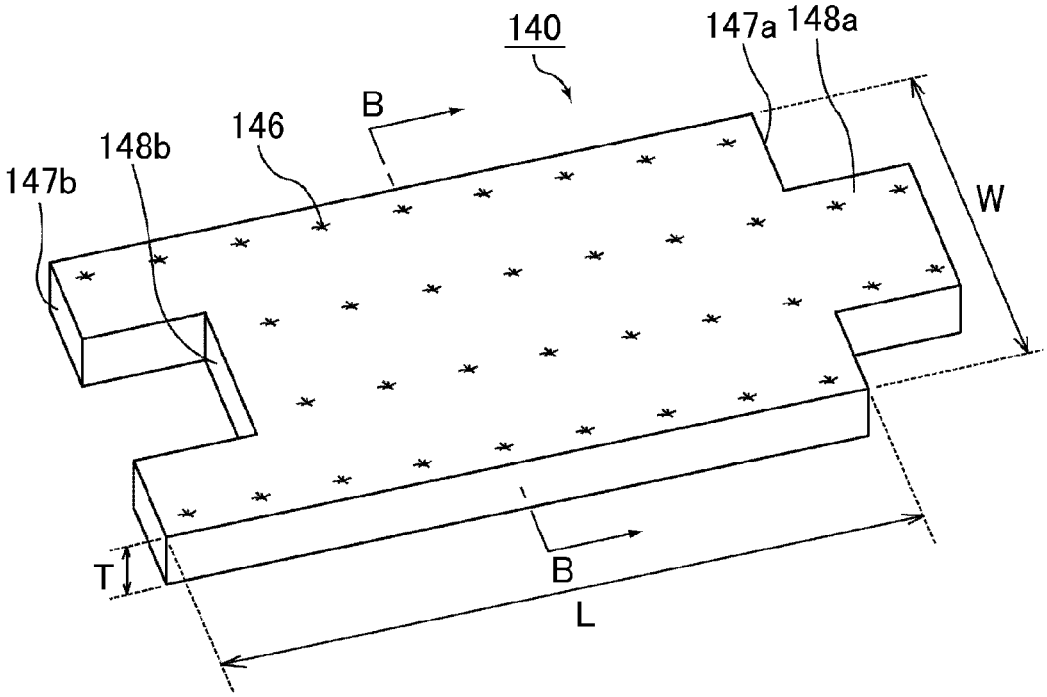
FIG. 7A is a perspective view that schematically illustrates an example of a holding sealing material in the exhaust gas purifying apparatus forming the exhaust gas purifying system of the first embodiment of the present invention.
Figure 7B:
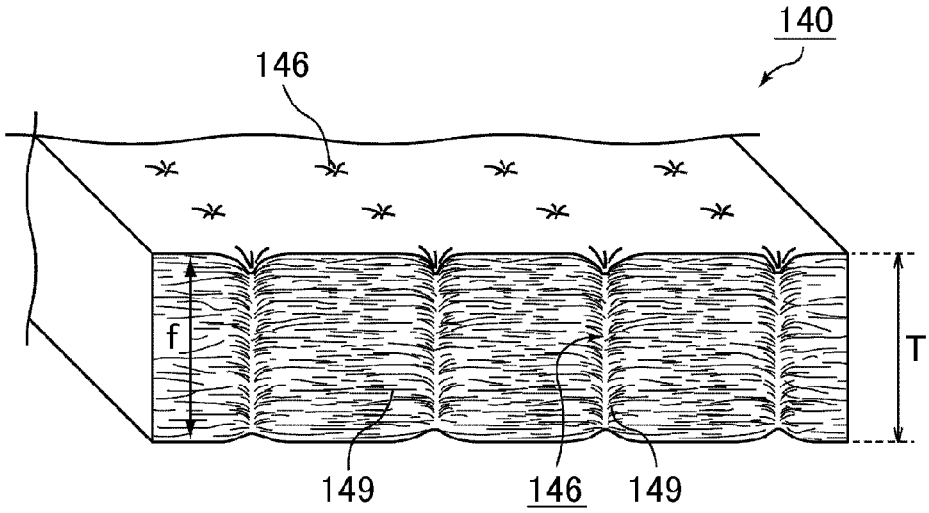
FIG. 7B is a B-B line cross-sectional view of the holding sealing material illustrated in FIG. 7A.

FIG. 7A is a perspective view that schematically illustrates an example of the holding sealing material in the exhaust gas purifying apparatus forming the exhaust gas purifying system of the first embodiment of the present invention, and FIG. 7B is a B-B line cross-sectional view of the holding sealing material illustrated in FIG. 7A.

The holding sealing material 140 shown in FIG. 7A and FIG. 7B contains inorganic fibers 149 such as alumina-silica fibers, and formed into a substantially rectangular flat plate shape on a plan view having predetermined length (indicated by arrow "L" in FIG. 7A), width (indicated by arrow "W" in FIG. 7A) and thickness (indicated by arrow "T" in FIG. 7A).

Moreover, of end faces 147*a* and 147*b* in parallel with the width direction of the holding sealing material 140, a projected portion 148*a* is formed on one end face 147*a*, and a recessed portion 148*b*, which has a shape to which the projected portion 148*a* is fitted when the holding sealing material 140 is folded so that the end face 147*a* and the end face 147*b* are made in contact with each other, is formed on the other end face 147*b*.

Such a holding sealing material can be manufactured by allowing the inorganic fibers to be entangled with one another by the use of a spinning method.

In the exhaust gas purifying apparatus forming the exhaust gas purifying system of the present embodiment, the holding sealing material is preferably a needled mat obtained by carrying out a needling treatment on a base mat containing inorganic fibers. The needling treatment refers to a treatment in which needles or the like serving as a fiber entangling means are inserting and withdrawing to and from the base mat. In the holding sealing material subjected to the needling treatment, inorganic fibers having a comparatively long fiber length are more likely to be three-dimensionally entangled with one another. For this reason, it may be easier to prevent the inorganic fibers from being split, and consequently to improve the strength of the needled mat.

In the case when the needled mat is used as the holding sealing material, the holding sealing material has a plurality of needle marks formed by the needling treatment.

The holding sealing material 140 shown in FIG. 7A and FIG. 7B is an example that has a plurality of needle marks 146. Each needle mark 146 includes inorganic fibers 149 that are aligned in a thickness direction of the holding sealing material and entangled with one another.

In the case when the inorganic fibers of the holding sealing material are aligned in a predetermined direction, it is considered that in the exhaust gas purifying apparatus, push-out intensity applied to the exhaust gas treating body and metal casing by the holding sealing material tends to be increased in directions of the needle mark (directions indicated by a double-headed arrow "f" in FIG. 7B) that is, in a direction in which the inorganic fibers are aligned.

In the holding sealing material 140, the holding sealing material 140 is in such a state as to be stitched in its thickness direction with the mutually entangled inorganic fibers 149, centered on the needle marks 146.

In contrast, in the holding sealing material 140, an area having no needle marks 146 formed therein is formed, with the inorganic fibers 149 that are not aligned in a specific direction being entangled with one another comparatively weakly, so that it is formed into a nonwoven fabric.

Consequently, in the holding sealing material 140, the area near the needle marks 146 tends to have a higher density in the inorganic fibers 149 than that in the area having no needle marks 146 formed therein.

In the exhaust gas purifying system of the present embodiment, on a cross section in parallel with the longitudinal direction of the exhaust gas purifying apparatus, although the shape of the needle marks and the direction in which the needle marks are formed are not particularly limited, the needle marks are preferably formed in a direction diagonal to the thickness direction of the holding sealing material. More specifically, in the exhaust gas purifying system prior to allowing exhaust gases to flow therein, the needle marks are preferably made substantially in parallel with a first slanting face and a second slanting face formed on the holding sealing material.

FIG. 6 shows an example in which the holding sealing material 140 forming the exhaust gas purifying apparatus 110 has the plurality of needle marks 146 formed in a direction diagonal to the thickness direction of the holding sealing material 140. In the exhaust gas purifying apparatus 110 shown in FIG. 6, the holding sealing material 140 is more easily allowed to push out the exhaust gas treating body 130 and the metal casing 120 in direction "f" of the needle marks substantially in parallel with the first slanting face and the second slanting face.

In the exhaust gas purifying apparatus forming the exhaust gas purifying system of the present embodiment, a binder may be added to the holding sealing material. The binder added to the holding sealing material more easily allows the inorganic fibers forming the holding sealing material to stick to one another. Therefore, by using the binder, the size of the holding sealing material may be reduced more easily upon being stuffed to the metal casing, or the inorganic fibers is more likely to be prevented from scattering.

Moreover, in the case when the binder is added to the holding sealing material, since the directions of needle marks can be easily maintained so that the force to be applied by the holding sealing material to push out the exhaust gas treating body and the metal casing tends to be increased. As a result, the holding strength of the holding sealing material tends to be improved.

As the method for adding a binder to the holding sealing material, for example, a method in which a predetermined amount of a binder solution is sprayed onto the holding sealing material by using a spray or the like so that the binder is adhered to the holding sealing material, or a method in which the holding sealing material is impregnated with a binder solution may be used.

As the binder solution, an emulsion, prepared by dispersing an organic binder such as an acrylic resin in water, may be used. Moreover, an appropriate amount of an inorganic binder such as alumina sol may be contained in the binder solution.

The amount of the binder to be added to the holding sealing material (hereinafter, referred to as "binder content") is preferably set to about 10% by weight or less, more preferably, in the range of about 0.5% by weight to about 6.0% by weight, most preferably, in the range of about 1.0% by weight to about 2.0% by weight, from the viewpoint of improving the holding strength of the holding sealing material.

The following description will discuss the exhaust gas treating body in the exhaust gas purifying apparatus forming the exhaust gas purifying system in accordance with the present embodiment.

Figure 8A:
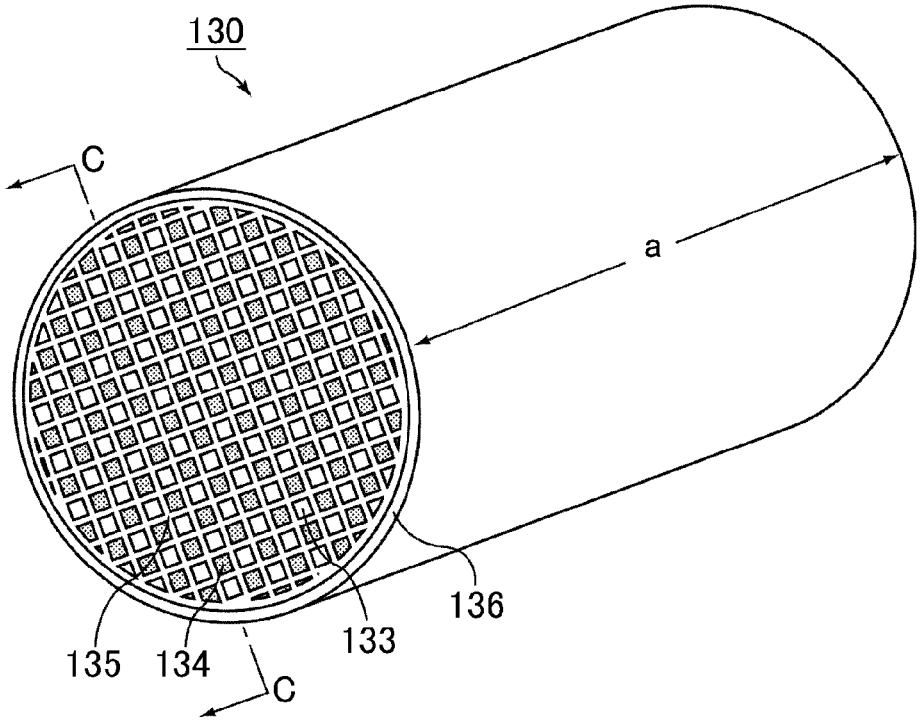
FIG. 8A is a perspective view that schematically illustrates an example of an exhaust gas treating body in the exhaust gas purifying apparatus forming the exhaust gas purifying system of the first embodiment of the present invention.
Figure 8B:
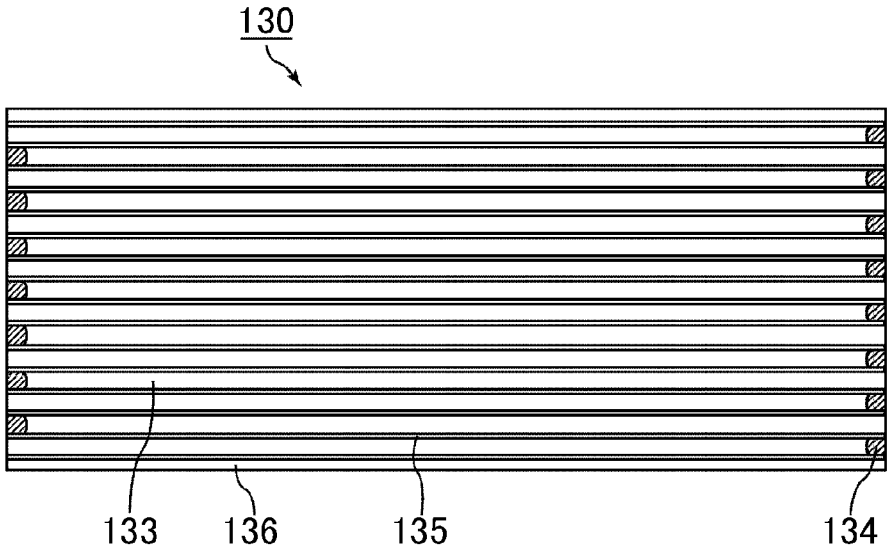
FIG. 8B is a C-C line cross-sectional view of the exhaust gas treating body illustrated in FIG. 8A.

FIG. 8A is a perspective view that schematically shows an example of the exhaust gas treating body in the exhaust gas purifying apparatus forming an exhaust gas purifying system in accordance with the first embodiment of the present invention. FIG. 8B is a C-C line cross-sectional view of the exhaust gas treating body shown in FIG. 8A.

As shown in FIG. 8A, an exhaust gas treating body 130 mainly includes a porous ceramic material, such as cordierite, and has a substantially round pillar-shape. Moreover, a coat layer 136 is formed on the outer periphery of the exhaust gas treating body 130 so as to reinforce the outer peripheral portion of the exhaust gas treating body 130, adjust the shape and improve the heat insulating property of the exhaust gas treating body 130. In this case, the coat layer may be formed, if necessary.

The exhaust gas treating body 130 shown in FIG. 8A is prepared as a honeycomb structure in which a large number of cells 133 are placed in parallel with one another in the longitudinal direction (in FIG. 8A, a direction indicated by a double-headed arrow "a"), with a cell wall 135 interposed therebetween.

Either one of ends of each cell 133 is sealed with a plug material 134. In this case, the exhaust gas treating body functions as a filter (honeycomb filter) for purifying PMs contained in exhaust gases. The exhaust gas purifying method in which the honeycomb filter is used as the exhaust gas treating body will be described later.

The following description will discuss the metal casing in the exhaust gas purifying apparatus forming the exhaust gas purifying system in accordance with the present embodiment.

Figure 9:
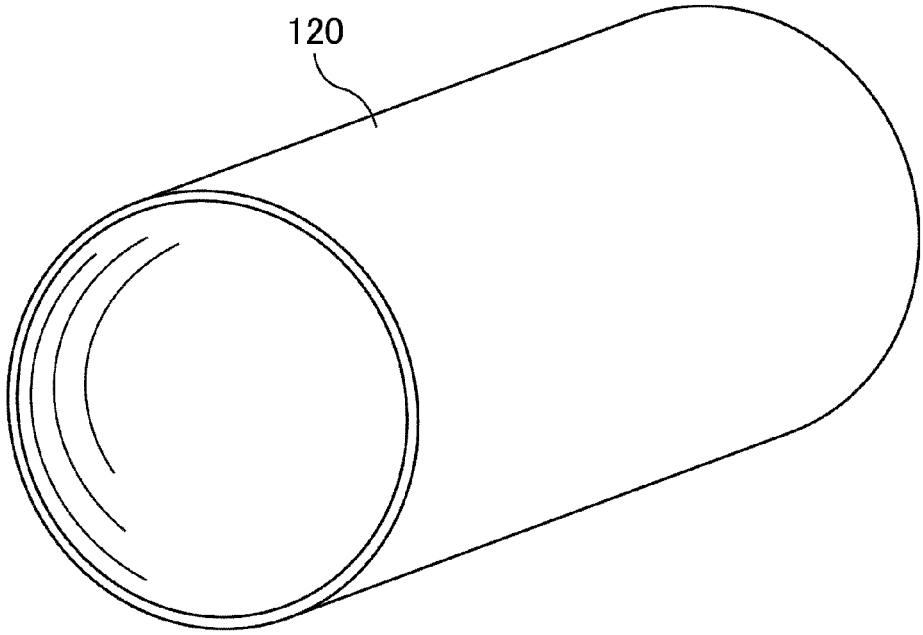
FIG. 9 is a perspective view that schematically illustrates an example of a metal casing in the exhaust gas purifying apparatus forming the exhaust gas purifying system of the first embodiment of the present invention.

FIG. 9 is a perspective view that schematically shows an example of the metal casing in the exhaust gas purifying apparatus forming the exhaust gas purifying system of the first embodiment of the present invention.

The metal casing 120 shown in FIG. 9 is mainly made of metal such as stainless steel, and has a substantially cylindrical shape. The inner diameter of the metal casing 120 is made slightly shorter than a combined length of the diameter of the end face of the exhaust gas treating body 130 shown in FIG. 8A and FIG. 8B and the thickness of the holding sealing material 140 wound around the exhaust gas treating body 130.

The length of the metal casing 120 is made slightly longer than the length in the longitudinal direction of the exhaust gas treating body 130 shown in FIG. 8A and FIG. 8B. The length of the metal casing may be substantially the same as the length in the longitudinal direction of the exhaust gas treating body.

The following description will discuss the inlet pipe and the exhaust pipe forming the exhaust gas purifying system in accordance with the present embodiment.

Figure 10A:
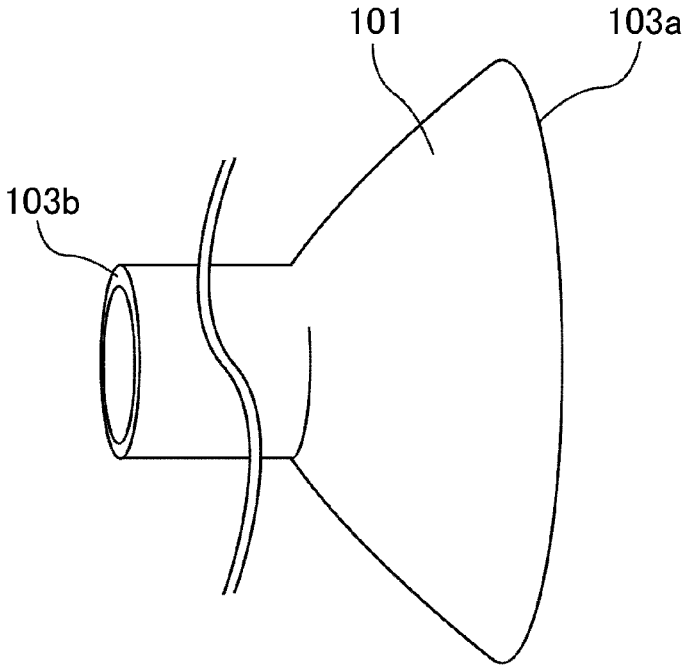
FIG. 10A is a perspective view that schematically illustrates an example of an inlet pipe forming the exhaust gas purifying system of the first embodiment of the present invention.
Figure 10B:
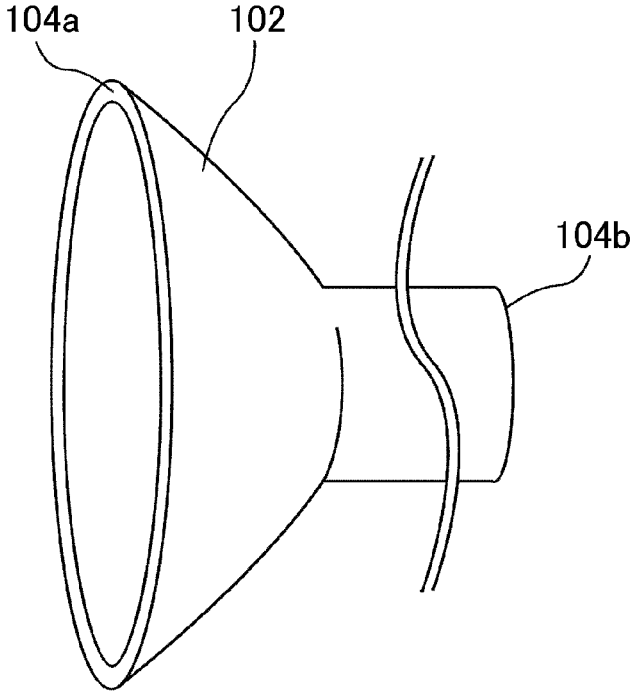
FIG. 10B is a perspective view that schematically illustrates an example of an exhaust pipe forming the exhaust gas purifying system of the first embodiment of the present invention.

FIG. 10A is a perspective view that schematically shows an example of the inlet pipe forming the exhaust gas purifying system of the first embodiment of the present invention. FIG. 10B is a perspective view that schematically shows an example of the exhaust pipe forming the exhaust gas purifying system of the first embodiment of the present invention.

The inlet pipe 101 shown in FIG. 10A is mainly made of metal such as stainless steel, and has a substantially cylindrical shape. As shown in FIG. 10A, the outer diameter (inner diameter) of one end face 103*a* of the inlet pipe 101 is made substantially the same as the outer diameter (inner diameter) of the metal casing 120 shown in FIG. 9. Moreover, the outer diameter (inner diameter) of the other end face 103*b* of the inlet pipe 101 is made smaller than the outer diameter (inner diameter) of the end face of the metal casing 120 shown in FIG. 9. The shape of one end face 103*a* of the inlet pipe 101 and the proximity thereof has a tapered shape that is narrowed from one end face 103*a* toward the other end face 103*b*.

The other end face 103*b* of this inlet pipe 101 is coupled to an internal combustion engine, after having been further connected to an exhaust gas pipe, if necessary.

The exhaust pipe 102 shown in FIG. 10B is mainly made of metal such as stainless steel, and has a substantially cylindrical shape. As shown in FIG. 10B, the outer diameter (inner diameter) of one end face 104*a* of the exhaust pipe 102 is made substantially the same as the outer diameter (inner diameter) of the metal casing 120 shown in FIG. 9. Moreover, the outer diameter (inner diameter) of the other end face 104*b* of the exhaust pipe 102 is made smaller than the outer diameter (inner diameter) of the end face of the metal casing 120 shown in FIG. 9. The shape of one end face 104*a* of the exhaust pipe 102 and the proximity thereof has a tapered shape that is narrowed from one end face 104*a* toward the other end face 104*b*.

The other end face 104*b* of this exhaust pipe 102 is coupled to the outside.

Referring to FIG. 3A and FIG. 3B, the following description will discuss an exhaust gas purifying method of the present embodiment by which exhaust gases are purified by using the exhaust gas purifying system having the above-mentioned structure.

Additionally, the exhaust gas purifying system 100 shown in FIG. 3A and FIG. 3B has a structure in which the honeycomb filter shown in FIG. 8A and FIG. 8B is used as the exhaust gas treating body 130.

When exhaust gases discharged from an internal combustion engine are allowed to flow into the exhaust gas purifying system 100 shown in FIG. 3A from the gas inlet side 111 of the exhaust gas purifying apparatus 110, in response to the flow of the exhaust gases, the exhaust gas treating body 130 is pressed onto the gas outlet side 112 of the exhaust gas purifying apparatus 110. As a result, as shown in FIG. 3B, the first slanting face formed on the first side face 141 of the holding sealing material 140 is shifted in the flow-in direction of the exhaust gases (in FIG. 3B, exhaust gases are indicated as "$G_1$", and the flow of exhaust gases is indicated by an arrow), that is, toward the gas outlet side 112 of the exhaust gas purifying apparatus 110 so that the first side face 141 of the holding sealing material 140 tends to be made substantially parallel to the outlet side end face 132 of the exhaust gas treating body 130. In the same manner, the second slanting face formed on the second side face 142 of the holding sealing material 140 is shifted toward the gas outlet side 112 of the exhaust gas purifying apparatus 110 so that the second side face 142 of the holding sealing material 140 tends to be made substantially parallel to the inlet side end face 131 of the exhaust gas treating body 130.

In the case when exhaust gases $G_1$ are allowed to flow into the exhaust gas purifying system 100, since the first side face 141 and the second side face 142 of the holding sealing material 140 tend to be kept substantially in parallel with the end face of the exhaust gas treating body 130, its facial pressure effective area tends to increase from $S_1$ to $S_2$. As a result, the holding strength of the holding sealing material tends to be improved.

In the exhaust gas purifying system of the present embodiment, the holding strength of the holding sealing material is maximized when the first side face and the second side face of the holding sealing material are made substantially parallel to the end face of the exhaust gas treating body.

The exhaust gas purifying system of the present embodiment is designed so that, not until at least the first side face and the second side face of the holding sealing material have been made substantially in parallel with the end face of the exhaust gas treating body, the exhaust gas treating body is held by the holding sealing material so as to be less likely to be shifted thereafter even upon receipt of flow-in exhaust gases.

As shown in FIG. 3B, the exhaust gases $G_1$ flowing into the exhaust gas purifying apparatus 110 from the gas inlet side 111 of the exhaust gas purifying apparatus 110 are further allowed to flow into one of the cells 133*a* of the exhaust gas treating body 130, with the end portion on the outlet side end face 132 being sealed. Moreover, the exhaust gases $G_1$ pass through the cell wall 135 that separates the corresponding one of the cells 133*a* and the other cell 133*b* whose end portion on the inlet side end face 131 of the exhaust gas treating body 130 is sealed. At this time, PMs in the exhaust gases are captured by the cell wall 135 so that the exhaust gases $G_1$ are purified.

The exhaust gases $G_1$ thus purified are allowed to flow into the other cell 133*b* and discharged outside of the exhaust gas purifying apparatus 110 from the gas outlet side 112 of the exhaust gas purifying apparatus 110. Thereafter, the exhaust gases $G_1$ are discharged outside through the exhaust pipe 102.

In this manner, the cell wall 135 that separates one of the cells 133*a* and the other cell 133*b* is allowed to function as a filter.

Figure 11A:
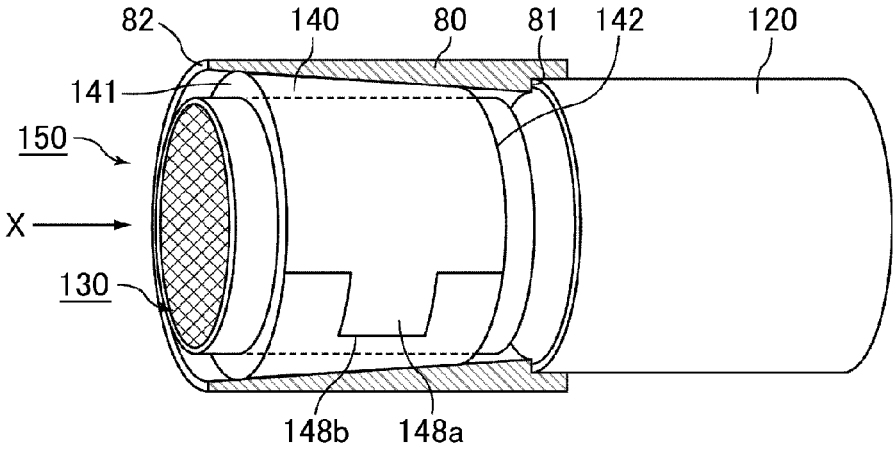
FIG. 11A is a perspective view that schematically shows an example of a stuffing step in accordance with the first embodiment of the present invention.
Figure 11B:
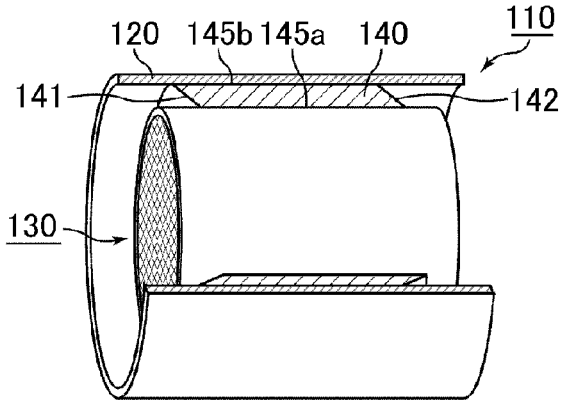
FIG. 11B is a partially exploded perspective cross-sectional view that schematically illustrates an exhaust gas purifying apparatus that is manufactured by the stuffing step shown in FIG. 11A.
Figure 11C:
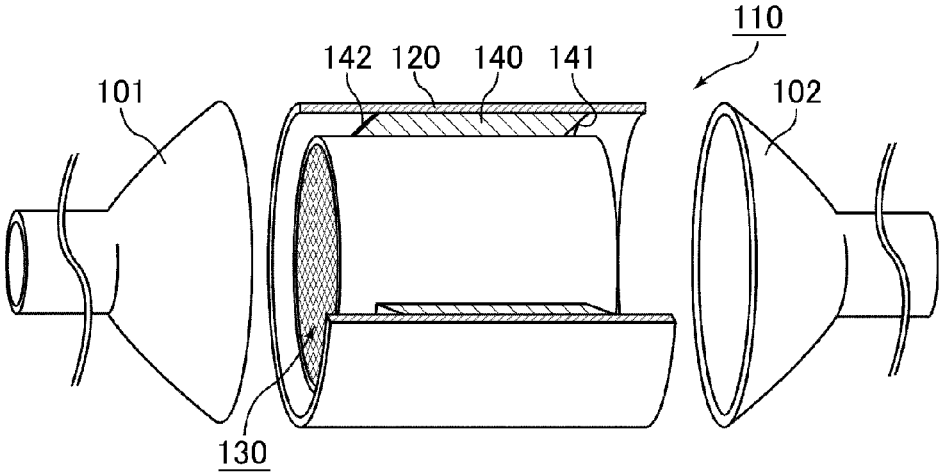
FIG. 11C is a perspective view that schematically shows an example of a connecting step in the first embodiment of the present invention.

Referring to FIGS. 11A, 11B, and 11C, the following description will discuss a method for manufacturing the exhaust gas purifying system of the present embodiment. In this case, the description will discuss the method for manufacturing the exhaust gas purifying system 100 shown in FIG. 4.

The manufacturing method of the exhaust gas purifying system of the present embodiment includes a stuffing step (a press-fitting step) and a connecting step.

FIG. 11A is a perspective view that schematically shows an example of the stuffing step of the first embodiment of the present invention. In FIG. 11A, the stuffing direction is indicated by an arrow "X".

As shown in FIG. 11A, first, a wound body 150 in which the holding sealing material 140 is wound on the periphery of the exhaust gas treating body 130 is prepared.

The wound body 150 can be manufactured by winding the holding sealing material 140 on the outer periphery of the exhaust gas treating body (honeycomb structure) 130, shown in FIG. 8A and FIG. 8B, with a projected portion 148*a* and a recessed portion 148*b* of the holding sealing material 140 shown in FIG. 7A being fitted to each other.

Next, the wound body is stuffed into a metal casing to manufacture an exhaust gas purifying apparatus (stuffing step).

In the stuffing step, with the second side face 142 of the holding sealing material 140 serving as a leading portion relative to the proceeding direction of the stuffing, the wound body 150 is pressed from the first side face 141 of the holding sealing material 140 so that the wound body 150 is stuffed to a predetermined position inside the metal casing 120.

The stuffing step shown in FIG. 11A corresponds to a method for stuffing the wound body 150 into the metal casing 120 by using a stuffing jig 80.

The stuffing jig 80 has a substantially cylindrical shape as a whole, with its inside being expanded from one end to the other end in a tapered state.

One end of the stuffing jig 80 forms an end portion on a shorter diameter side 81 having an inner diameter corresponding to a diameter slightly smaller than the inner diameter of the metal casing 120. Moreover, the other end of the stuffing jig 80 forms an end portion on a longer diameter side 82 having at least an inner diameter corresponding to the outer diameter of the wound body 150.

By using the stuffing jig 80, the wound body 150 may be more easily stuffed into the metal casing 120.

Additionally, the method for stuffing the wound body into the metal casing is not particularly limited, and, for example, a method may be used in which, by pushing the wound body with the hand, the wound body is stuffed into the metal casing.

In the method for manufacturing the exhaust gas purifying system of the present embodiment, by using a press machine or the like, the metal casing may be compressed from the outer peripheral side so as to shorten the inner diameter of the metal casing so that the wound body may be held.

By using the above-mentioned stuffing step, the exhaust gas purifying apparatus can be manufactured.

FIG. 11B is a partially exploded perspective cross-sectional view that schematically shows an exhaust gas purifying apparatus manufactured by the stuffing step shown in FIG. 11A.

Upon stuffing the wound body 150 into the metal casing 120, a shearing force is exerted between the first main surface 145*a* of the holding sealing material 140 in contact with the exhaust gas treating body 130 and the second main surface 145*b* of the holding sealing material 140 in contact with the metal casing 120, with the result that the position of the first main surface 145*a* and the position of the second main surface 145*b* tend to be mutually displaced from each other to cause the holding sealing material 140 to be deformed.

As a result, in the exhaust gas purifying apparatus 110 shown in FIG. 11B, the first side face 141 and the second side face 142 of the holding sealing material 140 are brought into a tilted state.

Next, an inlet pipe is connected to one of the ends of the exhaust gas purifying apparatus, and an exhaust pipe is connected to the other end of the exhaust gas purifying apparatus (connecting step).

FIG. 11C is a perspective view that schematically shows an example of a connecting step of the first embodiment of the present invention. In FIG. 11C, the direction of the exhaust gas purifying apparatus is reversed to that of FIG. 11B.

In the connecting step, first, of the ends of the exhaust gas purifying apparatus 110, one of the ends closer to the second side face 142 of the holding sealing material 140 than to the first side face 141 of the holding sealing material 140 is connected to an inlet pipe 101 by welding. Next, the other end closer to the first side face 141 of the holding sealing material 140 than to the second side face 142 of the holding sealing material 140 is connected to an exhaust pipe 102 by welding.

Additionally, in place of the welding, another joining method, such as a screw or a predetermined metal member, may be used.

By using the above-mentioned steps, the exhaust gas purifying system 100 shown in FIG. 4 can be manufactured.

In the exhaust gas purifying system 100 shown in FIG. 4, because of the above-mentioned connecting step, of the ends of the exhaust gas purifying apparatus 110, the end closer to the second side face 142 of the holding sealing material 140 than to the first side face 141 of the holding sealing material 140 is allowed to form the gas inlet side 111 of the exhaust gas purifying apparatus 110, while the end closer to the first side face 141 of the holding sealing material 140 than to the second side face 142 of the holding sealing material 140 is allowed to form the gas outlet side 112 of the exhaust gas purifying apparatus 110.

Hereinafter, the effects of the exhaust gas purifying system of the present embodiment, the manufacturing method of the exhaust gas purifying system, and the exhaust gas purifying method using the exhaust gas purifying system are listed.

(1) In the exhaust gas purifying system of the present embodiment, the first slanting face is formed on the first side face of the holding sealing material, and the second slanting face is formed on the second side face of the holding sealing material. Moreover, by the first slanting face and the second slanting face, the first side face and the second side face of the holding sealing material are allowed to tilt in a direction reversed to that of an exhaust gas purifying system manufactured by using a conventional method.

In the case when exhaust gases are allowed to flow into the exhaust gas purifying system of the present embodiment, the exhaust gas treating body is pressed toward the gas outlet side of the exhaust gas purifying apparatus in response to the flow of the exhaust gases. As a result, since the first slanting face formed on the first side face of the holding sealing material and the second slanting face formed on the second side face of the holding sealing material are shifted in the flow-in direction of the exhaust gases, that is, toward the gas outlet side of the exhaust gas purifying apparatus so that the first side face and the second side face tend to be gradually made substantially in parallel with the end face of the exhaust gas purifying treating body.

Upon allowing exhaust gases to flow into the exhaust gas purifying system of the present embodiment, since the first side face and the second side face of the holding sealing material tend to be made substantially in parallel with the end face of the exhaust gas treating body, the facial pressure effective area tends to increase. Consequently, the holding strength of the holding sealing material is more likely to be improved. In this manner, different from an exhaust gas purifying system manufactured by a conventional method, the exhaust gas purifying system of the present embodiment tends to generate a sufficient facial pressure relative to the exhaust gas treating body and the metal casing. As a result, since the holding strength of the holding sealing material is more likely to be prevented from being lowered even during flowing of the exhaust gases, the holding sealing material tends to sufficiently hold the exhaust gas treating body.

(2) In the exhaust gas purifying system of the present embodiment, since the holding sealing material forming the exhaust gas purifying apparatus tends to exert sufficient holding strength, the gap bulk density (GBD) of the holding sealing material placed between the exhaust gas treating body and the metal casing tends to be reduced. As a result, the amount of the holding sealing material forming the exhaust gas purifying apparatus is more likely to be reduced.

(3) In a conventional exhaust gas purifying system, since the holding strength of the holding sealing material forming the exhaust gas purifying apparatus is not sufficient, it is difficult to sufficiently hold the exhaust gas treating body by using only the holding sealing material. Consequently, it is necessary to use another holding material, such as a metal net, in order to hold the exhaust gas treating body. However, in the exhaust gas purifying system of the present embodiment, since the exhaust gas treating body tends to be sufficiently held only by the use of the holding sealing material, it may be easier to omit the use of another holding material such as a metal net.

(4) Moreover, in the exhaust gas purifying system of the present embodiment, the first slanting face is formed on the first side face of the holding sealing material, and the second slanting face is formed on the second side face of the holding sealing material. Therefore, the amount of scattered fibers of the inorganic fibers forming the holding sealing material from the gas inlet side of the exhaust gas purifying apparatus toward the internal combustion engine side may be reduced more easily.

(5) The method for manufacturing the exhaust gas purifying system of the present embodiment includes a stuffing step and a connecting step.

In the stuffing step, with the second side face of the holding sealing material serving as a leading portion relative to the proceeding direction of the stuffing, the exhaust gas treating body with the holding sealing material wound therearound is pressed from the first side face of the holding sealing material. Moreover, in the connecting step, of the ends of the exhaust gas purifying apparatus, one of the ends closer to the second side face of the holding sealing material than to the first side face of the holding sealing material is connected to the inlet pipe, with the other end closer to the first side face of the holding sealing material than to the second side face of the holding sealing material being connected to the exhaust pipe so that the end closer to the second side face of the holding sealing material than to the first side face of the holding sealing material is formed as a gas inlet side, with the end closer to the first side face of the holding sealing material than to the second side face of the holding sealing material being formed as a gas outlet side.

By using this manufacturing method, without the necessity of cutting the side face of the holding sealing material by using a cutting tool, such as a cutter, each time, it may be easier to form the first slanting face on the first side face of the holding sealing material and also to form the second slanting face on the second side face of the holding sealing material. For this reason, the exhaust gas purifying system according to the embodiments of the present invention, provided with an exhaust gas purifying apparatus in which the holding sealing material tends to exert sufficient holding strength, may be manufactured more easily and efficiently.

(6) Moreover, in the method for manufacturing the exhaust gas purifying system of the present embodiment, an exhaust gas purifying apparatus may be manufactured more easily by using a small amount of the holding sealing material, and the exhaust gas purifying system may be manufactured more easily by using such an exhaust gas purifying apparatus.

Furthermore, in the method for manufacturing the exhaust gas purifying system of the present embodiment, it may be easier to manufacture an exhaust gas purifying apparatus that tends to sufficiently hold the exhaust gas treating body by using only the holding sealing material, without the necessity of another holding material such as a metal net, and also to manufacture the exhaust gas purifying system by using such an exhaust gas purifying apparatus.

(7) The exhaust gas purifying method of the present embodiment is an exhaust gas purifying method for purifying exhaust gases discharged from an engine. In the exhaust gas purifying method of the present embodiment, exhaust gases discharged from an engine are allowed to flow into the exhaust gas purifying apparatus from the gas inlet side of the exhaust gas purifying apparatus, and are discharged from the gas outlet side of the exhaust gas purifying apparatus.

Upon allowing exhaust gases to flow into the exhaust gas purifying system of the present embodiment in the above-mentioned direction, since the exhaust gas treating body is pushed toward the gas outlet side of the exhaust gas purifying apparatus, the first side face and the second side face of the holding sealing material tend to be gradually made substantially parallel to the end face of the exhaust gas treating body. As a result, since the facial pressure effective area tends to increase, it may be easier to prevent the holding strength of the holding sealing material from being lowered even during flowing of the exhaust gases.

EXAMPLES

Hereinafter, Examples are described in which the first embodiment of the present invention is more specifically disclosed. Note that the present invention is not limited only to these Examples.

Example 1

(1) Manufacturing of Holding Sealing Material

As a base mat composed of alumina fibers (average fiber length: 50 mm, average fiber diameter: 5.5 μm) having an alumina-silica composition, a base mat having a compounding ratio of $Al_2O_3$:$SiO_2$=72:28 was prepared. A needled mat was manufactured by carrying out a needling treatment entirely on this base mat.

Next, the needled mat was cut to prepare a cut needled mat having a size of 266 mm (in length)×83.5 mm (in width) on a plan view. A binder solution was sprayed onto the cut needled mat by using a spray so as to be set to 1.0% by weight relative to the amount of alumina fibers of the cut needled mat so that the binder was uniformly adhered to the entire needled mat.

Additionally, as the binder solution, an acrylic latex emulsion prepared by sufficiently dispersing an acrylic resin in water was used.

Thereafter, the needled mat with the binder adhered thereto was dried at 140° C. for five minutes under a pressure of 70 kPa to manufacture a holding sealing material having a shape shown in FIG. 7A (L=266 mm, W=83.5 mm, T=7.9 mm), with a bulk density of 0.177 g/cm$^3$, a weight per unit area of 1400 g/m$^2$, and a binder content of 1.0% by weight.

(2) Manufacturing of Wound Body

A honeycomb structure (exhaust gas treating body) mainly including a porous ceramic material, having a round pillar shape with a size of 80 mm in diameter×95 mm in length, was prepared according to a conventionally known method.

Next, the holding sealing material manufactured in process (1) was wound around the outer peripheral portion of the prepared exhaust gas treating body without any gap so as to allow a projected portion and a recessed portion on the ends of the holding sealing material to be fitted to each other so that a wound body was manufactured.

The wound body thus manufactured has a first side face and a second side face.

(3) Manufacturing of Exhaust Gas Purifying Apparatus

A metal casing, made of stainless steel, having a cylindrical shape with a size of 88 mm (inner diameter)×115 mm (overall length) was prepared.

A stuffing jig having a shape as shown in FIG. 11A was prepared so as to stuff the wound body into the metal casing.

The end portion on the shorter diameter side of the prepared stuffing jig was fitted into one end of the metal casing, and the two members were secured to each other.

Next, with the second side face of the holding sealing material serving as a leading portion relative to the proceeding direction of the stuffing, the wound body was pressed from the first side face side of the holding sealing material so that the wound body was stuffed into the metal casing.

More specifically, with the wound body (the second side face side of the holding sealing material) pressed onto the end portion of the longer diameter side of the stuffing jig, by pushing the wound body from the first side face side of the holding sealing material, the wound body was stuffed so that the entire wound body was positioned inside the metal casing; thus, an exhaust gas purifying apparatus was manufactured.

The gap bulk density of the holding sealing material in the manufactured exhaust gas purifying apparatus is 0.35 g/cm$^3$.

(4) Manufacturing of Exhaust Gas Purifying System

With respect to the exhaust gas purifying apparatus thus manufactured, of the ends of the exhaust gas purifying apparatus, the end that was closer to the second side face of the holding sealing material than to the first side face of the holding sealing material was connected to an inlet pipe, and the end that was closer to the first side face of the holding sealing material than to the second side face of the holding sealing material was connected to an exhaust pipe so that an exhaust gas purifying system was manufactured.

In the manufactured exhaust gas purifying system, of the ends of the exhaust gas purifying apparatus, the end that was closer to the second side face of the holding sealing material than to the first side face of the holding sealing material was allowed to form a gas inlet side of the exhaust gas purifying apparatus, and the end that was closer to the first side face of the holding sealing material than to the second side face of the holding sealing material was allowed to form a gas outlet side of the exhaust gas purifying apparatus.

Additionally, the exhaust gas purifying system of Example 1 corresponds to the exhaust gas purifying system 100 shown in FIG. 4.

In the exhaust gas purifying system of Example 1, a first slanting face was formed on the first side face of the holding sealing material, and a second slanting face was formed on the second side face of the holding sealing material. Moreover, on a cross section in parallel with the longitudinal direction of the exhaust gas purifying apparatus, the first slanting face formed on the first side face of the holding sealing material has a first inside end point at which the holding sealing material and the exhaust gas treating body are made in contact with each other and a first outside end point at which the holding sealing material and the metal casing are made in contact with each other. The first inside end point of the holding sealing material is positioned closer to the gas inlet side of the exhaust gas purifying apparatus than the first outside end point of the holding sealing material, and the first slanting face is directed toward the first outside end point from the first inside end point.

Moreover, on the cross section in parallel with the longitudinal direction of the exhaust gas purifying apparatus, the second slanting face formed on the second side face of the holding sealing material has a second inside end point at which the holding sealing material and the exhaust gas treating body are made in contact with each other and a second outside end point at which the holding sealing material and the metal casing are made in contact with each other. The second inside end point of the holding sealing material is positioned closer to the gas inlet side of the exhaust gas purifying apparatus than the second outside end point of the holding sealing material, and the second slanting face is directed toward the second outside end point from the second inside end point.

When a first angle on the first slanting face was measured, 61.2° was obtained as the first angle.

Example 2 and Example 3

By carrying out the same processes as those of Example 1 except that by altering the concentration of the binder to be adhered to the cut needled mat, the binder content of the holding sealing material was set to 6.0% by weight (Example 2) as well as to 10% by weight (Example 3) so that holding sealing materials were manufactured. Moreover, by using these holding sealing materials, wound bodies were manufactured in the same manner as in Example 1 so that exhaust gas purifying apparatuses were manufactured. By using the exhaust gas purifying apparatuses thus manufactured, the inlet pipe and exhaust pipe were connected thereto in the same manner as in Example 1 so that exhaust gas purifying systems were manufactured.

The gap bulk density, the binder content and the first angle of the holding sealing material in each of the exhaust gas purifying systems of Example 2 and Example 3 are shown in Table 1.

Examples 4 to 8

The same processes as those of Example 1 were carried out except that the bulk density of the holding sealing material was altered so as to set the gap bulk density of the holding sealing material in the exhaust gas purifying apparatus forming the exhaust gas purifying system to values indicated in Table 1 so that holding sealing materials were manufactured. Moreover, by using these holding sealing materials, the same processes as those of Example 1 were carried out so that wound bodies were manufactured, and exhaust gas purifying apparatuses were manufactured. By using the exhaust gas purifying apparatuses thus manufactured, the inlet pipe and exhaust pipe were connected thereto in the same manner as in Example 1 so that exhaust gas purifying systems were manufactured.

The gap bulk density, the binder content and the first angle of the holding sealing material in each of the exhaust gas purifying systems of Examples 4 to 8 are shown in Table 1.

Example 9

By carried out the same processes as those of Example 1 except that no needling treatment was carried out on a base mat upon manufacturing a holding sealing material, a holding sealing material was manufactured. Moreover, by using this holding sealing material, the same processes as those of Example 1 were carried out so that a wound body was manufactured, and an exhaust gas purifying apparatus was manufactured. By using the exhaust gas purifying apparatus thus manufactured, the inlet pipe and exhaust pipe were connected thereto in the same manner as in Example 1 so that an exhaust gas purifying system was manufactured.

The gap bulk density, the binder content and the first angle of the holding sealing material in the exhaust gas purifying system of Example 9 are shown in Table 1.

Comparative Example 1

With respect to the exhaust gas purifying apparatus manufactured in Example 1, in a manner opposite to that of Example 1, of the ends of the exhaust gas purifying apparatus, the end that was closer to the first side face of the holding sealing material than to the second side face of the holding sealing material was connected to an inlet pipe, and the end that was closer to the second side face of the holding sealing material than to the first side face of the holding sealing material was connected to an exhaust pipe so that an exhaust gas purifying system was manufactured.

In the manufactured exhaust gas purifying system, of the ends of the exhaust gas purifying apparatus, the end that was closer to the first side face of the holding sealing material than to the second side face of the holding sealing material was allowed to form a gas inlet side of the exhaust gas purifying apparatus, and the end that was closer to the second side face of the holding sealing material than to the first side face of the holding sealing material was allowed to form a gas outlet side of the exhaust gas purifying apparatus.

Additionally, the exhaust gas purifying system of Comparative Example 1 corresponds to the exhaust gas purifying system 200 shown in FIG. 1, manufactured by a conventional method.

In the exhaust gas purifying system of Comparative Example 1 as well, a first slanting face was formed on the first side face of the holding sealing material, and a second slanting face was formed on the second side face of the holding sealing material. However, in the exhaust gas purifying system of Comparative Example 1, both of the first side face and the second side face are tilted in a direction reversed to that of the exhaust gas purifying system of Example 1.

The gap bulk density, the binder content and the first angle of the holding sealing material in the exhaust gas purifying system of Comparative Example 1 are shown in Table 1. The gap bulk density and the binder content of the holding sealing material in the exhaust gas purifying system of Comparative Example 1 are the same as those values in Example 1. In contrast, the first angle of the holding sealing material in the exhaust gas purifying system of Comparative Example 1 is the same as that of Example 1; however, the direction of the angle is opposite to that of Example 1. In this case, in Table 1, the first angle of the holding sealing material is indicated by a minus value.

Comparative Examples 2 to 7

With respect to each of the exhaust gas purifying apparatuses manufactured in Examples 2 to 7, in the same manner as in Comparative Example 1, of the ends of the exhaust gas purifying apparatus, the end that was closer to the first side face of the holding sealing material than to the second side face of the holding sealing material was connected to an inlet pipe, and the end that was closer to the second side face of the holding sealing material than to the first side face of the holding sealing material was connected to an exhaust pipe so that an exhaust gas purifying system was manufactured.

The gap bulk density, the binder content and the first angle of the holding sealing material in each of the exhaust gas purifying systems of Comparative Examples 2 to 7 are shown in Table 1.

In order to evaluate characteristics of the exhaust gas purifying systems of the respective Examples and Comparative Examples, the push-out intensity and the amount of scattered fibers were evaluated on each of the exhaust gas purifying apparatuses prior to the connecting of the inlet pipe and the exhaust pipe.

(Evaluation of Push-Out Intensity)

With respect to each of the exhaust gas purifying apparatuses in the exhaust gas purifying systems of the respective Examples and Comparative Examples, the push-out intensity of the wound body was measured by using the following method, and this value was used as an index of the holding strength of the holding sealing material upon allowing exhaust gases to flow into the exhaust gas purifying apparatus from the gas inlet side of the exhaust gas purifying apparatus.

Figure 12A:
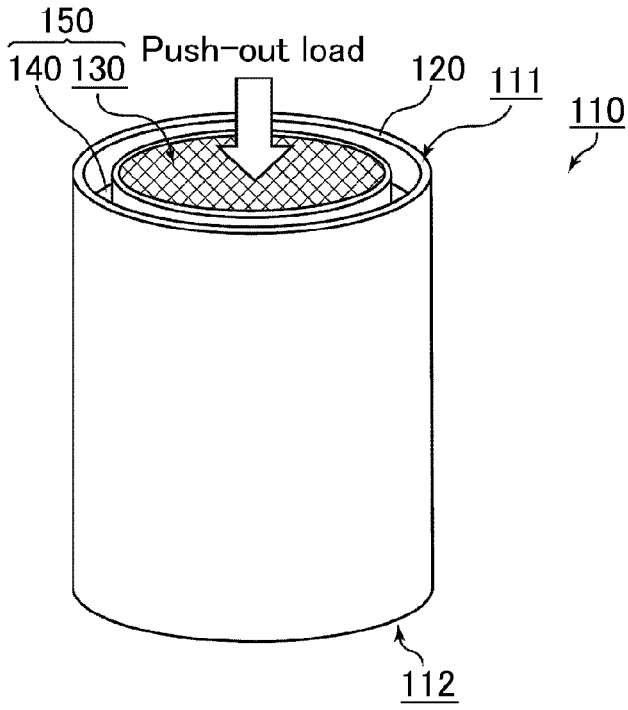
FIG. 12A is a perspective view that schematically illustrates a method for measuring a push-out intensity.
Figure 12B:
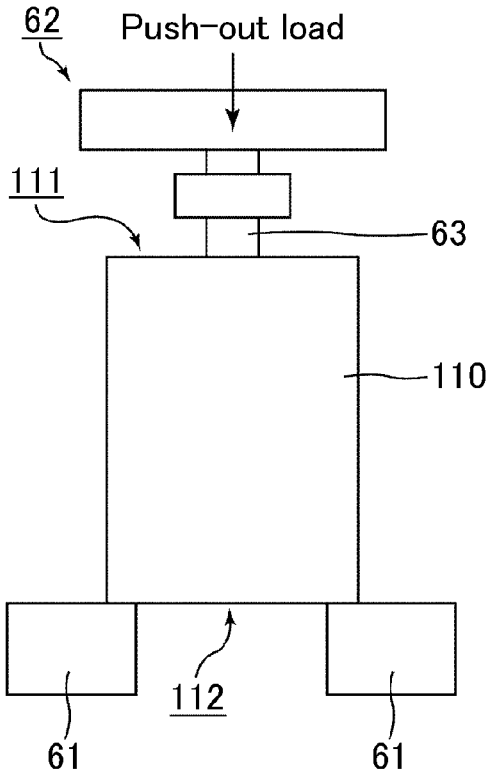
FIG. 12B is a front view that schematically shows a push-out intensity tester.

FIG. 12A is a perspective view that schematically illustrates a method for measuring a push-out intensity, and FIG. 12B is a front view that schematically shows a push-out intensity tester. In FIG. 12A and FIG. 12B, a method for measuring the push-out intensity of the exhaust gas purifying apparatus in each of the exhaust gas purifying systems of the respective Examples was illustrated.

First, as shown in FIG. 12A and FIG. 12B, the exhaust gas purifying apparatus 110 of each of the exhaust gas purifying systems of the respective Examples was mounted on a base 61, with a gas inlet side 111 of the exhaust gas purifying apparatus 110 facing up.

Next, a push-out load (pressing velocity: 1 mm/min) was applied onto the exhaust gas treating body 130 by a push-out jig 62. The maximum value of the push-out load (N) up to a point of time at which the wound body 150 (the exhaust gas treating body 130 with a holding sealing material 140 wound therearound) had been pushed out was measured. The push-out jig 62 was made of aluminum, with a diameter of a load portion 63 in contact with the wound body 150 being set to 30 mm.

A value obtained by dividing this maximum value of the push-out load (N) by an area ($cm^2$) of the holding sealing material was defined as a push-out intensity ($N/cm^2$) serving as a holding strength between the holding sealing material and the metal casing.

Figure 13A:
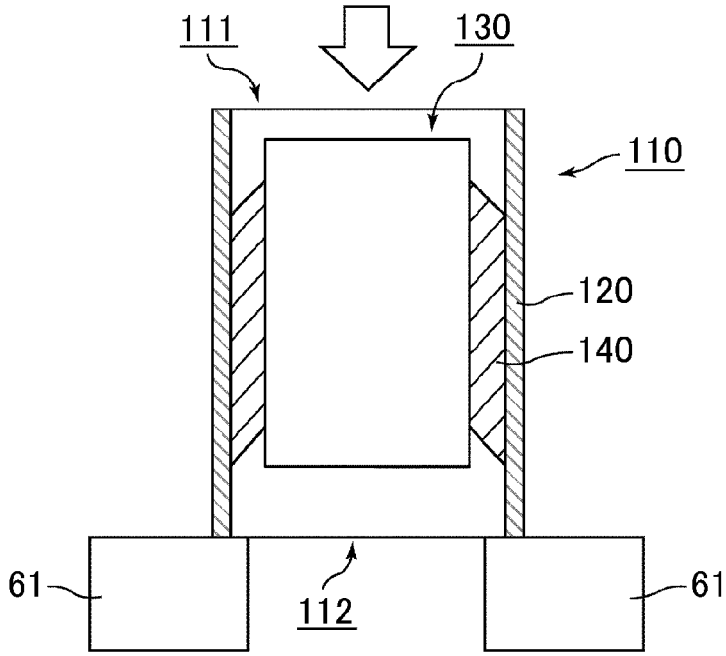
FIG. 13A is a cross-sectional view that schematically illustrates a state in which the push-out intensity of the exhaust gas purifying apparatus is measured in the exhaust gas purifying system of each of Examples.
Figure 13B:
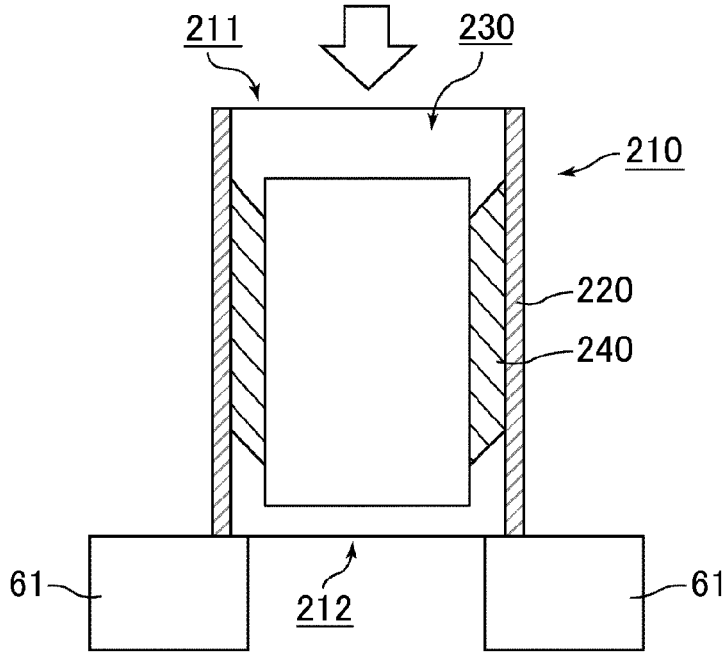
FIG. 13B is a cross-sectional view that schematically illustrates a state in which the push-out intensity of the exhaust gas purifying apparatus is measured in the exhaust gas purifying system of each of Comparative Examples.

On the other hand, with respect to each of the exhaust gas purifying apparatuses in the exhaust gas purifying systems of the respective Comparative Examples, as shown in FIG. 13B, an exhaust gas purifying apparatus 210 of each of the exhaust gas purifying systems of the respective Comparative Examples was mounted on a base 61, with a gas inlet side 211 of the exhaust gas purifying apparatus 210 facing up, and the push-out intensity was measured by using the same method as described earlier.

FIG. 13A is a cross-sectional view that schematically illustrates a state in which the push-out intensity of the exhaust gas purifying apparatus is measured in the exhaust gas purifying system of each of Examples, and FIG. 13B is a cross-sectional view that schematically illustrates a state in which the push-out intensity of the exhaust gas purifying apparatus is measured in the exhaust gas purifying system of each of Comparative Examples.

Upon measuring the push-out intensity, an instron universal tester (model 5582) was used.

The push-out intensities of the exhaust gas purifying apparatuses of the respective exhaust gas purifying systems of Examples 1 to 9 were respectively obtained as values: 4.58 $N/cm^2$, 5.42 $N/cm^2$, 6.38 $N/cm^2$, 2.29 $N/cm^2$, 3.33 $N/cm^2$, 5.58 $N/cm^2$, 6.92 $N/cm^2$, 8.29 $N/cm^2$, and 4.20 $N/cm^2$. On the other hand, the push-out intensities of the exhaust gas purifying apparatuses of the respective exhaust gas purifying systems of Comparative Examples 1 to 7 were respectively obtained as values: 3.22 $N/cm^2$, 4.11 $N/cm^2$, 5.17 $N/cm^2$, 1.42 $N/cm^2$, 2.11 $N/cm^2$, 4.02 $N/cm^2$, and 4.71 $N/cm^2$.

Table 1 shows the results of measurements on the push-out intensity of the exhaust gas purifying apparatus of each of the exhaust gas purifying systems of the respective Examples and Comparative Examples.

(Evaluation of Amount of Scattered Fibers)

With respect to the exhaust gas purifying apparatus in each of the exhaust gas purifying systems of Example 1 and Comparative Example 1, the amount of scattered fibers was measured by using the following method, and the corresponding value was used as an index of the amount of scattered fibers from the gas inlet side of the exhaust gas purifying apparatus.

Figure 14:
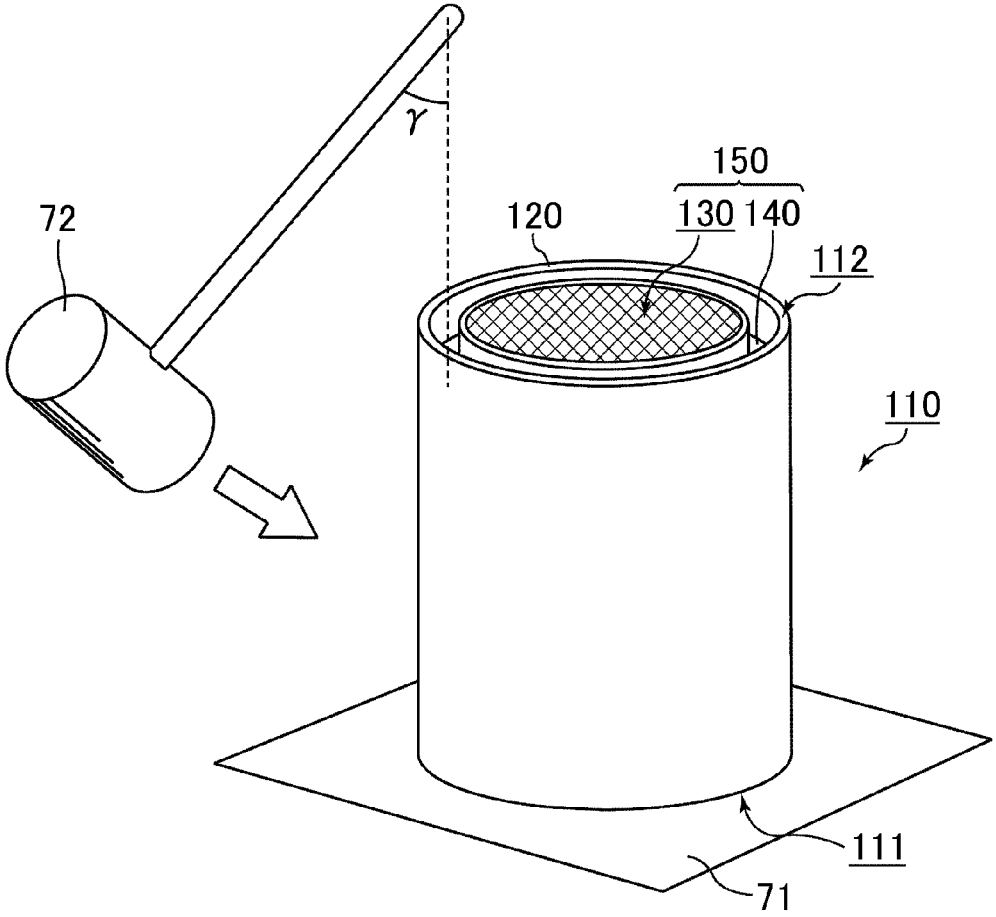
FIG. 14 is a perspective view that schematically illustrates a method for measuring the amount of scattered fibers.

FIG. 14 is a perspective view that schematically illustrates a method for measuring the amount of scattered fibers. In FIG. 14, the method for measuring the amount of scattered fibers of the exhaust gas purifying apparatus in the exhaust gas purifying system of Example 1 is shown.

As shown in FIG. 14, an exhaust gas purifying apparatus 110 with an end face of an exhaust gas treating body 130 being subjected to a masking treatment was mounted on paper 71, with the gas inlet side 111 of the exhaust gas purifying apparatus 110 facing down.

Next, as shown in FIG. 14, an impact was applied onto the exhaust gas purifying apparatus 110 by using a hammer 72 so that the weight (mg) of fibers dropped on the paper 71 was measured by using an electronic scale. The weight of the fibers was defined as an amount of scattered fibers (mg).

Figure 15A:
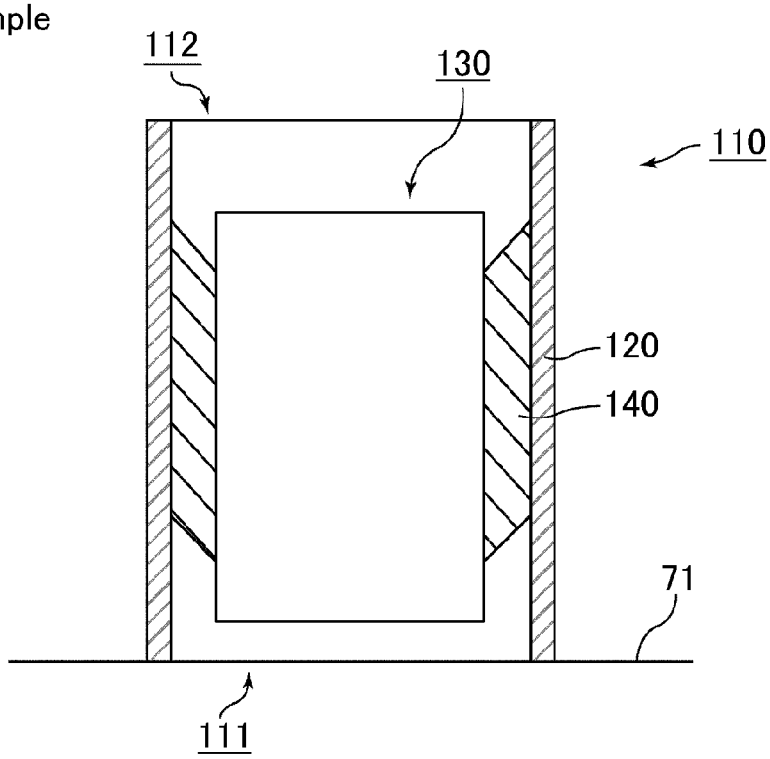
FIG. 15A is a cross-sectional view that schematically illustrates a state in which the amount of scattered fibers of the exhaust gas purifying apparatus is measured in the exhaust gas purifying system in Example 1.
Figure 15B:
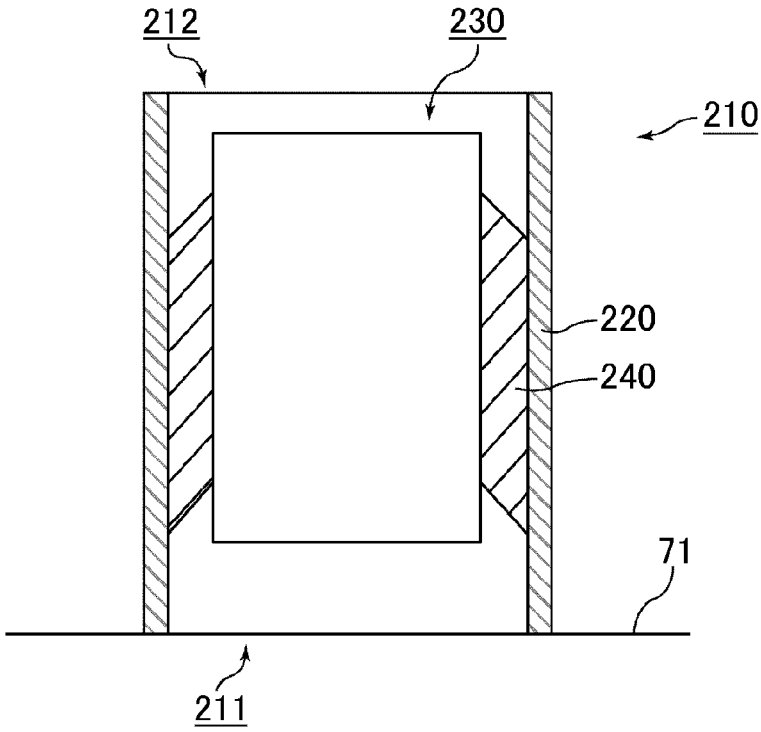
FIG. 15B is a cross-sectional view that schematically illustrates a state in which the amount of scattered fibers of the exhaust gas purifying apparatus is measured in the exhaust gas purifying system in Comparative Example 1.

On the other hand, with respect to the exhaust gas purifying apparatus in the exhaust gas purifying system of Comparative Example 1, as shown in FIG. 15B, an exhaust gas purifying apparatus 210 with an end face of an exhaust gas treating body 230 being subjected to a masking treatment was mounted on paper 71, with the gas inlet side 211 of the exhaust gas purifying apparatus 210 facing down, and the amount of scattered fibers was measured by using the same method as described above.

FIG. 15A is a cross-sectional view that schematically illustrates a state in which the amount of scattered fibers of the exhaust gas purifying apparatus is measured in the exhaust gas purifying system in Example 1, and FIG. 15B is a cross-sectional view that schematically illustrates a state in which the amount of scattered fibers of the exhaust gas purifying apparatus is measured in the exhaust gas purifying system in Comparative Example 1.

Upon measuring the amount of scattered fibers, an impact tester, shown in FIG. 14, was used. The angle of a raised hammer was set to 90° (angle indicated by "γ" in FIG. 14). At this time, the impact force caused by the hammer was 0.24 N·m. Positions at which the impact was applied to the exhaust gas purifying apparatus by the hammer were determined as positions (five positions) centered on the exhaust gas purifying apparatus in the longitudinal direction, forming five equal portions on the circumference thereof. Impacts were applied to the exhaust gas purifying apparatus by the hammer two times for each of the positions, that is, 10 times in total.

As a result, the amount of scattered fibers of the exhaust gas purifying apparatus in the exhaust gas purifying system of Example 1 was 0.267 mg. On the other hand, the amount of scattered fibers of the exhaust gas purifying apparatus in the exhaust gas purifying system of Comparative Example 1 was 1.30 mg.

With respect to the exhaust gas purifying systems of the respective Examples and Comparative Examples, the gap bulk density, the binder content and the first angle of the holding sealing material, and the presence or absence of the needling treatment on the holding sealing material, as well as the measured results of the push-out intensity, were collectively shown in Table 1.

Figure 16:
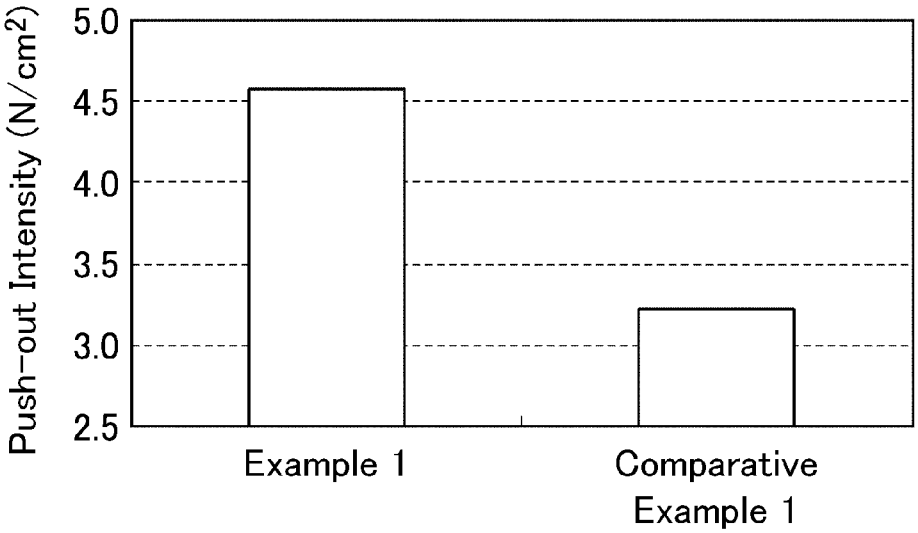
FIG. 16 is a graph that shows the results of measurements of the push-out intensity in Example 1 and Comparative Example 1.

FIG. 16 is a graph that shows the results of measurements of the push-out intensity in Example 1 and Comparative Example 1.

Figure 17:
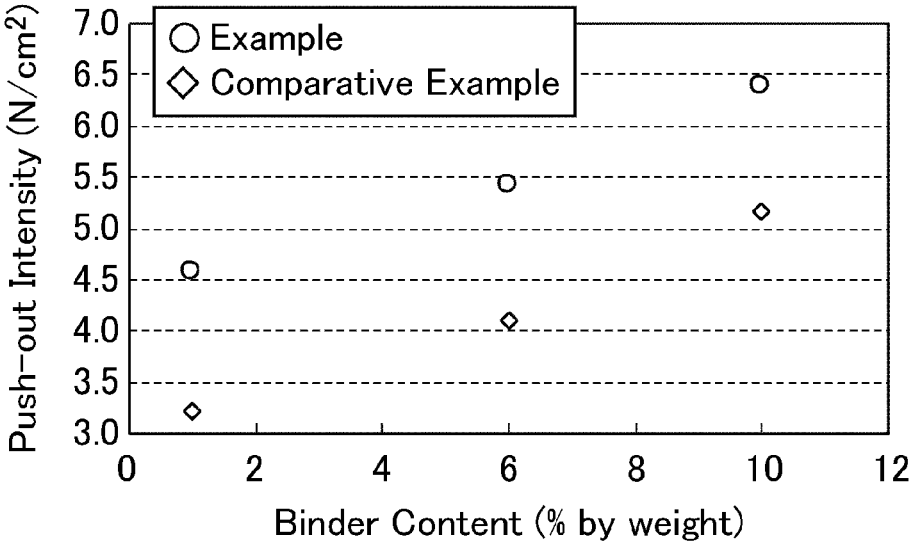
FIG. 17 is a graph that indicates a relationship between a binder content in the holding sealing material and a push-out intensity based upon measured results of the push-out intensity in Example 1 to Example 3, as well as in Comparative Example 1 to Comparative Example 3.

FIG. 17 is a graph that indicates a relationship between a binder content in the holding sealing material and the push-out intensity based upon measured results of the push-out intensity in Example 1 to Example 3, as well as in Comparative Example 1 to Comparative Example 3.

Figure 18:
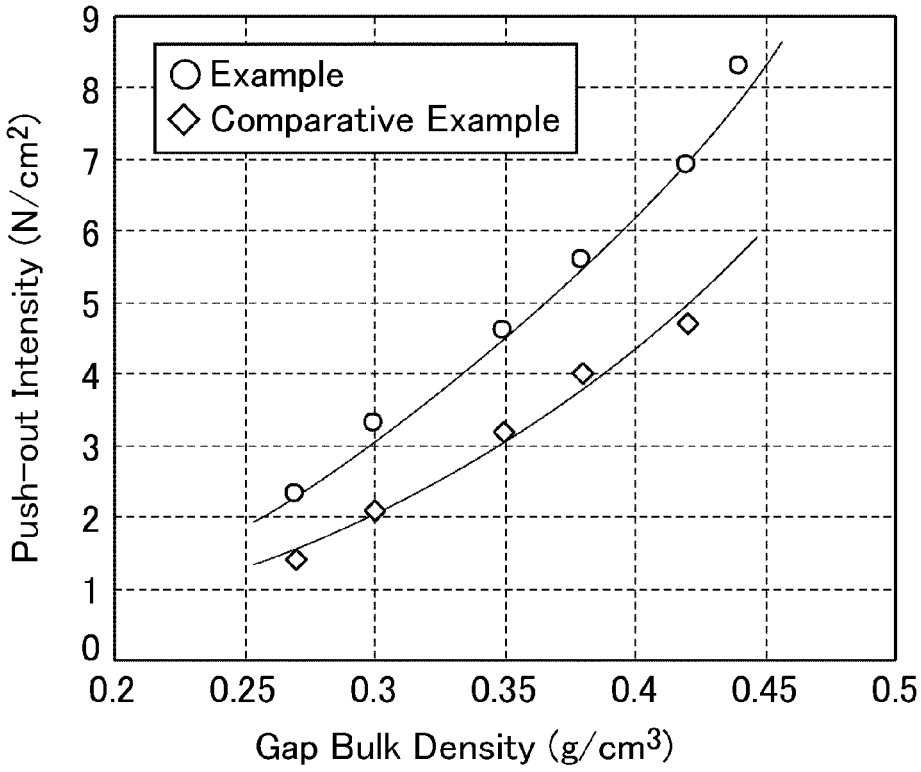
FIG. 18 is a graph that indicates a relationship between a gap bulk density of the holding sealing material and a push-out intensity based upon measured results of the push-out intensity in Example 1 and Examples 4 to 8, as well as in Comparative Example 1 and Comparative Examples 4 to 7.

FIG. 18 is a graph that indicates a relationship between a gap bulk density of the holding sealing material and the push-out intensity based upon measured results of the push-out intensity in Example 1 and Examples 4 to 8, as well as in Comparative Example 1 and Comparative Examples 4 to 7.

Figure 19:
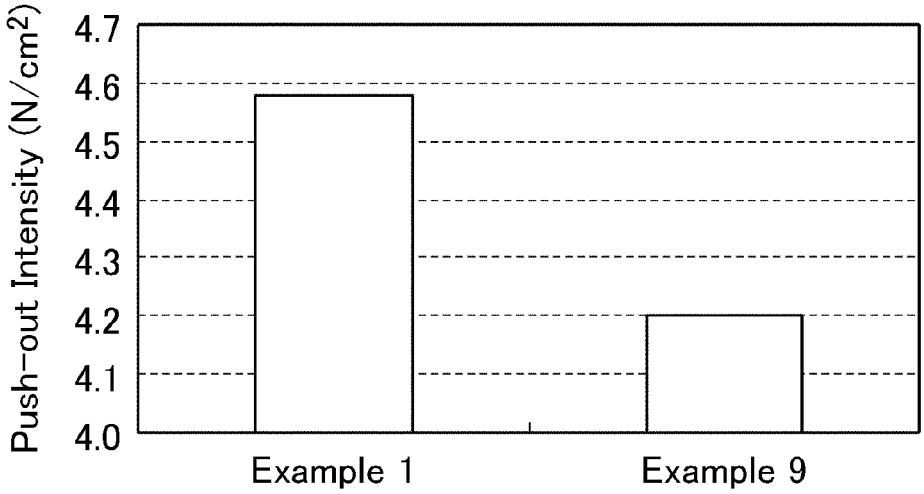
FIG. 19 is a graph that shows the results of measurements of the push-out intensity in Example 1 and Example 9.

FIG. 19 is a graph that shows the results of measurements of the push-out intensity in Example 1 and Example 9.

Figure 20:
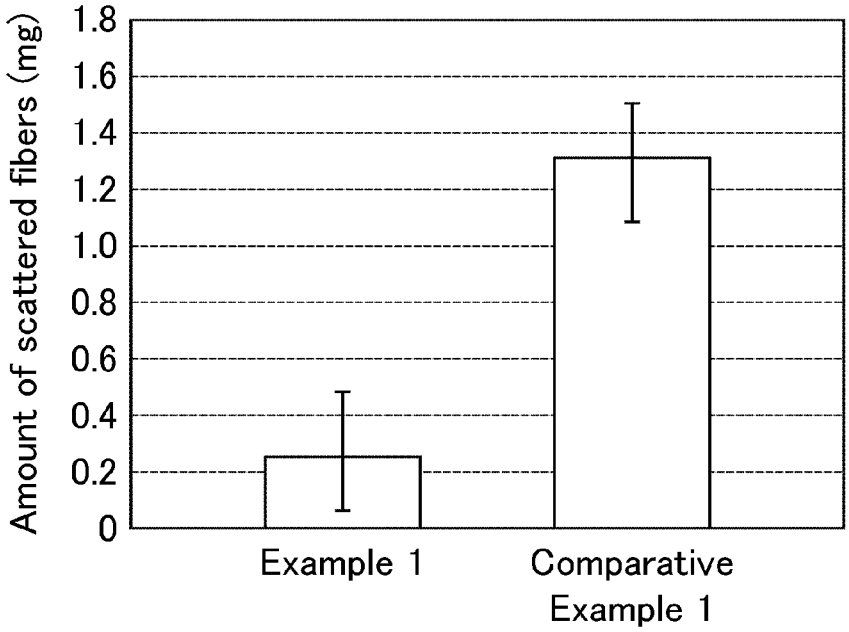
FIG. 20 is a graph that shows the results of measurements of the amount of scattered fibers in Example 1 and Comparative Example 1.

FIG. 20 is a graph that shows the results of measurements of the amount of scattered fibers in Example 1 and Comparative Example 1.

TABLE 1

| | Holding Sealing Material | | | | Exhaust Gas Purifying |
|---|---|---|---|---|---|
| | Gap Bulk Density ($g/cm^3$) | Binder Content (% by weight) | First Angle (degrees) | Needling Treatment | Apparatus Push-out Intensity ($N/cm^2$) |
| Example 1 | 0.35 | 1.0 | 61.2 | Treated | 4.58 |
| Example 2 | 0.35 | 6.0 | 57.8 | Treated | 5.42 |
| Example 3 | 0.35 | 10 | 69.2 | Treated | 6.38 |
| Example 4 | 0.27 | 1.0 | 70.5 | Treated | 2.29 |
| Example 5 | 0.30 | 1.0 | 67.6 | Treated | 3.33 |
| Example 6 | 0.38 | 1.0 | 56.8 | Treated | 5.58 |
| Example 7 | 0.42 | 1.0 | 49.9 | Treated | 6.92 |
| Example 8 | 0.44 | 1.0 | 46.0 | Treated | 8.29 |
| Example 9 | 0.35 | 1.0 | 81.5 | Not treated | 4.20 |
| Comparative Example 1 | 0.35 | 1.0 | −61.2 | Treated | 3.22 |
| Comparative Example 2 | 0.35 | 6.0 | −57.8 | Treated | 4.11 |
| Comparative Example 3 | 0.35 | 10 | −69.2 | Treated | 5.17 |
| Comparative Example 4 | 0.27 | 1.0 | −70.5 | Treated | 1.42 |
| Comparative Example 5 | 0.30 | 1.0 | −67.6 | Treated | 2.11 |
| Comparative Example 6 | 0.39 | 1.0 | −56.8 | Treated | 4.02 |
| Comparative Example 7 | 0.41 | 1.0 | −49.9 | Treated | 4.71 |

Moreover, based upon the results of measurements of the push-out intensity of Examples 1 to 3 as well as Comparative Examples 1 to 3, the rate of increase with push-out intensity was found in each of cases when the binder content of the holding sealing material was 1.0% by weight, when the binder content thereof was 6.0% by weight, and when the binder content thereof was 10.0% by weight. The rate of increase with push-out intensity was found on Examples and Comparative Examples in which the binder content of the holding sealing material was the same, based upon an equation "[Rate of increase with push-out intensity (%)]=[[Push-out intensity ($N/cm^2$) in Example]−[Push-out intensity ($N/cm^2$) in Comparative Example]]/[Push-out intensity ($N/cm^2$) in Comparative Example]×100". Table 2 shows the results thereof.

Figure 21:
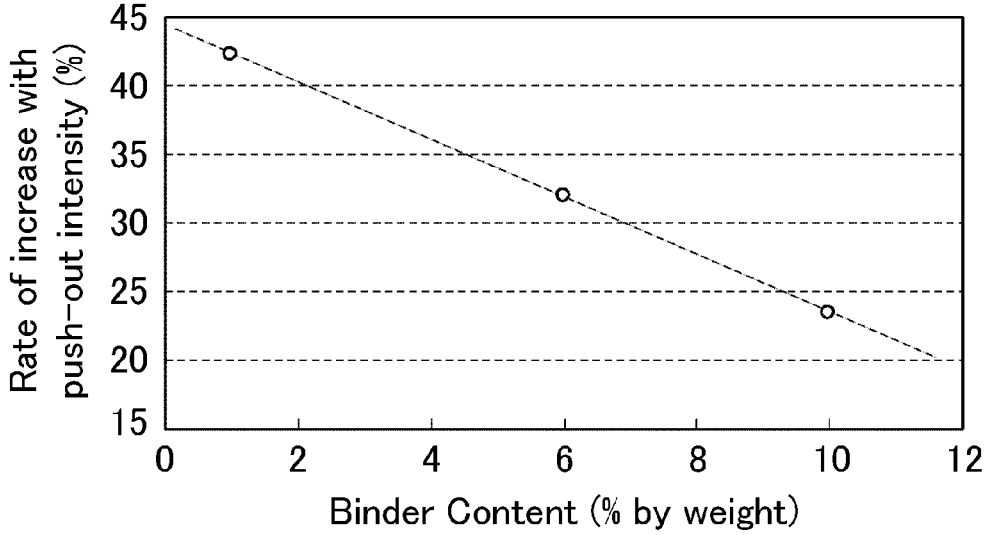
FIG. 21 is a graph that shows a relationship between the binder content in the holding sealing material and the rate of increase with push-out intensity.

Moreover, FIG. 21 is a graph that shows a relationship between the binder content in a holding sealing material and the rate of increase with push-out intensity.

TABLE 2

| Binder Content (% by weight) | Rate of increase with push-out intensity (%) |
|---|---|
| 1.0 | 42.2 |
| 6.0 | 31.9 |
| 10 | 23.4 |

As shown in Table 1 and FIG. 16, in the case of Example 1 in which the first angle on the first slanting face formed on the holding sealing material indicates a plus value, the push-out intensity was 4.6 $N/cm^2$. In contrast, in the case of Comparative Example 1 in which the first angle on the first slanting face formed on the holding sealing material indicates a minus value, the push-out intensity was 3.2 $N/cm^2$. Based upon these results, in the exhaust gas purifying system, by tilting the first side face of the holding sealing material to a direction reversed to that of an exhaust gas purifying system manufactured by a conventional method, the facial pressure effective area tends to be increased in response to exhaust gases flowing thereto; therefore, the holding strength of the holding sealing material presumably tends to be improved.

The following description will discuss influences to be given to the push-out intensity by the binder content of the holding sealing material.

As shown in Table 1 and FIG. 17, in any of binder contents, the push-out intensity in Examples had a value greater than that of the push-out intensity in Comparative Examples.

Based upon the results of these, it is considered that, by adding a binder to the holding sealing material forming the exhaust gas purifying apparatus, the holding strength of the holding sealing material tends to be improved. Moreover, in the exhaust gas purifying system, by tilting the first side face of the holding sealing material to a direction reversed to that of an exhaust gas purifying system manufactured by a conventional method, the effect for more easily improving the holding strength of the holding sealing material is considered to be exerted irrespective of the content of the binder.

Moreover, FIG. 17 indicates that as the binder content of the holding sealing material increases, the push-out intensity presumably tends to be improved.

In contrast, FIG. 21 indicates that as the binder content of the holding sealing material increases, the rate of increase with push-out intensity presumably tends to reduce.

Based upon these facts, it is considered that, although the holding strength of the holding sealing material tends to be improved by adding a binder to the holding sealing material that forms the exhaust gas purifying apparatus, the effect for improving the holding strength of the holding sealing material tends to become greater as the binder content becomes smaller.

Next, the following description will discuss influences to be given to the push-out intensity by the gap bulk density of the holding sealing material.

As shown in Table 1 and FIG. 18, in the gap bulk densities of all the holding sealing materials, the push-out intensity in Examples had a value greater than that of the push-out intensity of Comparative Examples.

Based upon the results of these, it is considered that in the exhaust gas purifying system, by tilting the first side face of the holding sealing material to a direction reversed to the direction of an exhaust gas purifying system manufactured by a conventional method, the effect for more easily improving the holding strength of the holding sealing material is considered to be exerted irrespective of the gap bulk density of the holding sealing material.

Moreover, as indicated by FIG. 18, the push-out intensity presumably tends to be increased as the gap bulk density of the holding sealing material becomes greater.

Next, the following description will discuss influences to be given to the push-out intensity by the needling treatment.

As shown in FIG. 19, the push-out intensity in Example 1 in which the holding sealing material was subjected to the needling treatment had a value greater than that of the push-out intensity of Example 9 in which the holding sealing material was not subjected to the needling treatment. This fact indicates that by carrying out the needling treatment on the holding sealing material forming the exhaust gas purifying apparatus, the inorganic fibers forming the holding sealing material tend to be aligned in a direction perpendicular to the surface of the holding sealing material so that the holding strength of the holding sealing material presumably tends to be further improved.

Next, the following description will discuss the amount of scattered fibers.

FIG. 20 indicates that the amount of scattered fibers in Example 1 is extremely smaller than the amount of scattered fibers in Comparative Example 1. This fact indicates that in the exhaust gas purifying system, by tilting the first side face of the holding sealing material to a direction reversed to that of an exhaust gas purifying system manufactured by a conventional method, the inorganic fibers that form the holding sealing material tend to be constrained by the holding strength of the holding sealing material so that the amount of scattered inorganic fibers toward the internal combustion engine side from the gas inlet side of the exhaust gas purifying apparatus is more likely to be reduced.

Other Embodiments

In the exhaust gas purifying system according to the embodiments of the present invention, the metal casing in the exhaust gas purifying apparatus forming the exhaust gas purifying system may have distinguished portions as to a gas inlet side forming the gas inlet side of the exhaust gas purifying apparatus and a gas outlet side forming the gas outlet side of the exhaust gas purifying apparatus.

In the case when there are distinguished portions as to the gas inlet side and the gas outlet side in the metal casing forming the exhaust gas purifying apparatus, by determining a direction in which the wound body is fitted to the metal casing prior to the stuffing step, the exhaust gas purifying apparatus having the first slanting face formed on the first side face of the holding sealing material and the second slanting face formed on the second side face of the holding sealing material may be manufactured more easily so that an exhaust gas purifying system may be manufactured more easily by using such an exhaust gas purifying apparatus.

Figure 22A:
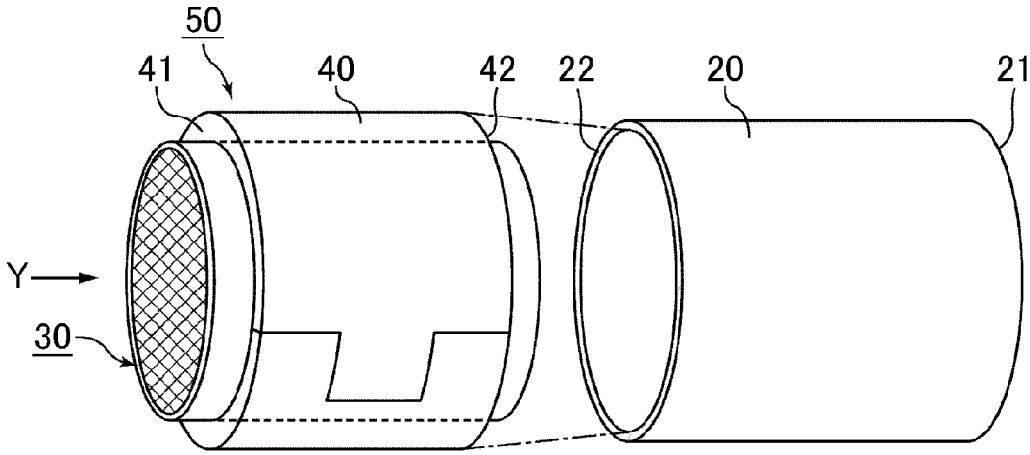
FIG. 22A is a perspective view that schematically illustrates an example of an arrangement step in accordance with the embodiment of the present invention.
Figure 22B:
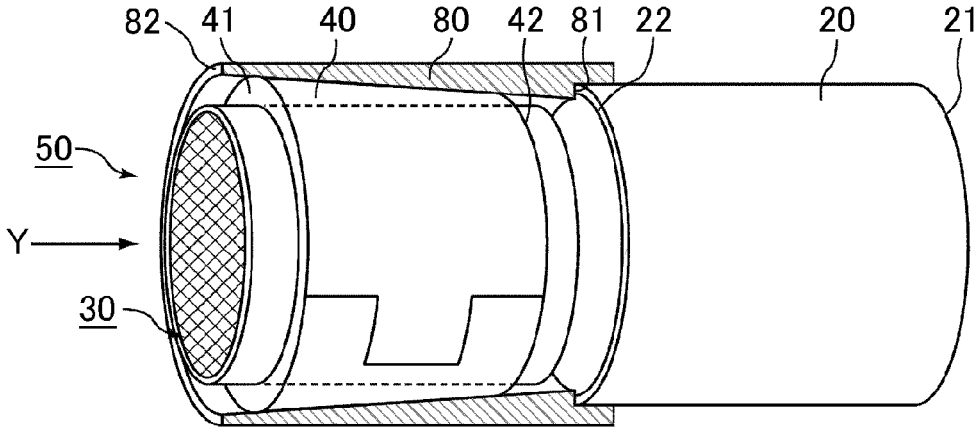
FIG. 22B is a partially exploded perspective cross-sectional view that schematically illustrates an example of a stuffing step in accordance with the embodiment of the present invention.
Figure 22C:
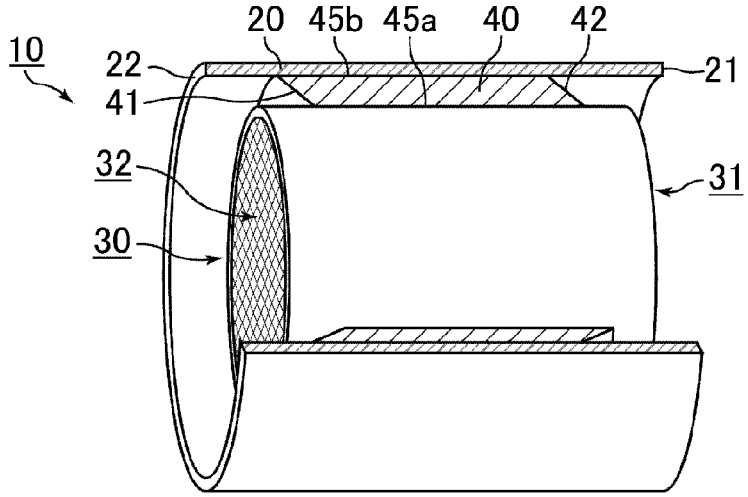
FIG. 22C is a partially exploded perspective cross-sectional view that schematically illustrates an exhaust gas purifying apparatus manufactured through the arrangement step shown in FIG. 22A and the stuffing step shown in FIG. 22B.

Referring to FIGS. 22A, 22B, and 22C, the following description will discuss a method for manufacturing the exhaust gas purifying apparatus forming the exhaust gas purifying system according to the embodiments of the present invention, when there are distinguished gas inlet side and gas outlet side in the metal casing forming the exhaust gas purifying apparatus.

In the case when there are distinguished gas inlet side and gas outlet side in the metal casing forming the exhaust gas purifying apparatus, prior to the stuffing step explained in the first embodiment of the present invention, an arrangement step is further carried out in which the exhaust gas treating body around which the holding sealing material has been wound is arranged, with the second side face of the holding sealing material serving as a leading portion relative to a proceeding direction of the stuffing, so that the first side face of the holding sealing material is positioned on the gas outlet side of the metal casing, with the second side face of the holding sealing material being positioned on the gas inlet side of the metal casing.

FIG. 22A is a perspective view that schematically shows an example of the arrangement step in accordance with the embodiment of the present invention. In FIG. 22A, the stuffing direction is indicated by an arrow "Y".

As illustrated in FIG. 22A, first, a wound body 50 in which a holding sealing material 40 is wound on the periphery of an exhaust gas treating body 30 is prepared. Since the method for manufacturing the wound body has been explained in the first embodiment of the present invention, the description thereof is omitted.

Next, the wound body is arranged in a predetermined orientation relative to the metal casing (arrangement step).

In the arrangement step, the wound body 50 is arranged, with the second side face 42 of the holding sealing material 40 serving as a leading portion relative to a proceeding direction of the stuffing, so that the first side face 41 of the holding sealing material 40 is positioned on the gas outlet side 22 of the metal casing 20, with the second side face 42 of the holding sealing material 40 being positioned on the gas inlet side 21 of the metal casing 20.

Next, the stuffing step for stuffing the wound body arranged at the above-mentioned position into the metal casing is carried out.

FIG. 22B is a partially exploded perspective cross-sectional view that schematically shows an example of the stuffing step in accordance with the embodiment of the present invention. In FIG. 22B, the stuffing direction is indicated by an arrow "Y".

In the stuffing step, by pushing the wound body 50 from the first side face 41 of the holding sealing material 40, the wound body 50 is stuffed into a predetermined position inside the metal casing 20.

As the method for stuffing the wound body into the metal casing, for example, a method using the stuffing jig explained in the first embodiment of the present invention may be used.

By using the above-mentioned steps, an exhaust gas purifying apparatus can be manufactured.

FIG. 22C is a partially exploded perspective cross-sectional view that schematically shows an exhaust gas purifying apparatus manufactured through the arrangement step shown in FIG. 22A and the stuffing step shown in FIG. 22B.

In the exhaust gas purifying apparatus 10 thus manufactured, the exhaust gas treating body 30 is provided with an inlet side end face 31 positioned on the gas inlet side 21 of the metal casing 20 and an outlet side end face 32 positioned on the gas outlet side 22 of the metal casing 20.

Upon stuffing the wound body 50 to the inside of the metal casing 20, a shearing force is exerted between a first main face 45*a* of the holding sealing material 40 in contact with the exhaust gas treating body 30 and a second main face 45*b* of the holding sealing material 40 in contact with the metal casing 20, so that the mutual positions of the first main face 45*a* and the second main face 45*b* are displaced to cause the holding sealing material 40 to be deformed more easily.

As a result, in the exhaust gas purifying apparatus 10 shown in FIG. 22C, the first side face 41 and the second side face 42 of the holding sealing material 40 are brought into a tilted state.

With respect to the exhaust gas purifying apparatus manufactured through the above-mentioned steps, an inlet pipe is connected to the gas inlet side of the metal casing forming the exhaust gas purifying apparatus and an exhaust pipe is connected to the gas outlet side of the metal casing forming the exhaust gas purifying apparatus so that an exhaust gas purifying system having the structure according to the embodiments of the present invention can be manufactured.

In the exhaust gas purifying system of the first embodiment of the present invention, the first slanting face is formed on the first side face of the holding sealing material, and the second slanting face is formed on the second side face of the holding sealing material. In the exhaust gas purifying system according to the embodiments of the present invention, it is preferable to form the second slanting face on the second side face of the holding sealing material; however, it is not necessarily required to form the second slanting face on the second side face of the holding sealing material.

As the method in which the first slanting face is formed on the first side face of the holding sealing material, while the second slanting face is not formed on the second side face of the holding sealing material, for example, a method in which the side face of the holding sealing material is cut by using a cutting tool such as a cutter may be used.

In the exhaust gas purifying system according to the embodiments of the present invention, the first slanting face and the second slanting face formed on the holding sealing material are not particularly limited in its cross-sectional shape, as long as the inside end point and the outside end point of the holding sealing material satisfy the positional relationship explained in the first embodiment of the present invention, and any desired shapes formed by using lines, such as a substantially straight line, a curved line and a polygonal line, may be used.

In the exhaust gas purifying system according to the embodiments of the present invention, the first slanting face to be formed on the holding sealing material is not necessarily required to be formed over the entire portion of the first side face of the holding sealing material. For example, by cutting one portion of the first side face of the holding sealing material by using a cutting tool such as a cutter, the first slanting face may be formed only on one portion of the first side face of the holding sealing material. In the same manner, in the exhaust gas purifying system according to the embodiments of the present invention, the second slanting face to be formed on the holding sealing material is not necessarily required to be formed over the entire portion of the second side face of the holding material, and may be formed only on one portion of the second side face of the holding sealing material.

In the exhaust gas purifying system of the first embodiment of the present invention, the width of the holding sealing material is set to be shorter than the length in the longitudinal direction of the exhaust gas treating body.

In the exhaust gas purifying system according to the embodiments of the present invention, not particularly limited, the width of the holding sealing material may be made substantially the same as the length in the longitudinal direction of the exhaust gas treating body, or may be made longer than the length in the longitudinal direction of the exhaust gas treating body.

Moreover, in the exhaust gas purifying system according to the embodiments of the present invention, in the case when the width of the holding sealing material is longer than the length in the longitudinal direction of the exhaust gas treating body, there is neither the first inside end point nor the second inside end point at which the holding sealing material and the exhaust gas treating body are made in contact with each other, on the side face of the holding sealing material. However, even in such a structure, supposing that the length in the longitudinal direction of the exhaust gas treating body is longer than the width of the holding sealing material, the points at which the two members are made in contact with each other are referred to as the first inside end point and the second inside end point respectively.

In the exhaust gas purifying system according to the embodiments of the present invention, the shapes of the recessed portion and the projected portion formed on the end faces of the holding sealing material are not particularly limited as long as the corresponding shapes allow the recessed portion and the projected portion to be fitted to each other, and in the case when one set of the recessed portion and projected portion is prepared, a projected portion that protrudes over a size ranging from about 20 mm in width×about 20 mm in length to about 100 mm in width×about 100 mm in length is preferably formed on one portion of one of end faces thereof, with a recessed portion having a corresponding shape to be fitted thereto being preferably formed on one portion of the other end face. In the case when an exhaust gas purifying system is manufactured by using the holding sealing material having these recessed portion and projected portion with the above-mentioned shapes, since the exhaust gas treating body tends to be positively held by the holding sealing material so that the resulting exhaust gas purifying system is allowed to have a superior handling characteristic.

Moreover, on the end faces of the holding sealing material, a plurality of sets of the recessed portion and the projected portion to be fitted to each other may be formed, or neither the recessed portion nor the projected portion may be formed.

In the exhaust gas purifying system according to the embodiments of the present invention, as the inorganic fibers forming the holding sealing material, not limited to the aforementioned inorganic fibers containing alumina and silica, inorganic fibers containing another inorganic compound may be used.

Moreover, of alumina and silica, the inorganic fibers containing only alumina or the inorganic fibers containing only silica may be used.

As the compounding ratio of the inorganic fibers containing alumina and silica, a weight ratio in a range from $Al_2O_3$: $SiO_2$=about (60:40) to about (80:20) is preferably used, and more preferably, a weight ratio in a range from $Al_2O_3$: $SiO_2$=about (70:30) to about (74:26) is used.

In the case of the inorganic fibers containing only alumina of alumina and silica, in addition to alumina, for example, additives, such as CaO, MgO and $ZrO_2$, may be contained therein.

In the case of the inorganic fibers containing only silica of alumina and silica, in addition to silica, for example, additives, such as CaO, MgO and $ZrO_2$, may be contained therein.

In the exhaust gas purifying system according to the embodiments of the present invention, the average fiber length of the inorganic fibers forming the holding sealing material is preferably set in the range of about 0.5 cm to about 10 cm, more preferably, in the range of about 1 cm to about 8 cm.

In the exhaust gas purifying system according to the embodiments of the present invention, the average fiber diameter of the inorganic fibers forming the holding sealing material is preferably set in the range of about 1 μm to about 20 μm, more preferably, in the range of about 3 μm to about 10 μm.

In the exhaust gas purifying system according to the embodiments of the present invention, although not particularly limited, the weight per unit area of the holding sealing material is preferably set in the range of about 500 $g/m^2$ to about 5000 $g/m^2$, more preferably, in the range of about 1000 $g/m^2$ to about 4000 $g/m^2$.

Moreover, in the exhaust gas purifying system according to the embodiments of the preset invention, although not particularly limited, the bulk density (bulk density of the holding sealing material prior to the stuffing of the wound body to the metal casing) of the holding sealing material is preferably set in the range of about 0.10 $g/cm^3$ to about 0.30 $g/cm^3$.

In the exhaust gas purifying system according to the embodiments of the present invention, although not particularly limited, the thickness of the holding sealing material is preferably set in the range of about 6 mm to about 31 mm, more preferably, in the range of about 8 mm to about 20 mm.

In the exhaust gas purifying system of the first embodiment of the present invention, the holding sealing material is prepared as a needled mat having been subjected to a needling treatment. In the exhaust gas purifying system according to the embodiments of the present invention, the holding sealing material may be preferably subjected to the needling treatment, or may not be subjected to the needling treatment.

Moreover, in the case of the holding sealing material subjected to the needling treatment, the needling treatment may be carried out over the entire base mat including inorganic fibers, or may be carried out on one portion of the base mat.

In the exhaust gas purifying system according to the embodiments of the present invention, in the case when a binder is added to the holding sealing material, as an organic binder contained in a binder solution to be used upon manufacturing the holding sealing material, for example, an acrylic resin, rubber such as acrylic rubber, an water soluble organic polymer, such as carboxymethyl cellulose, or polyvinyl alcohol, a thermoplastic resin, such as styrene resin, and a thermosetting resin, such as an epoxy resin, may be used.

Among these, acrylic rubber, acrylonitrile-butadiene rubber, and styrene-butadiene rubber are in particular preferably used.

The amount of the organic binder to be blended is preferably set to about 15% by weight or less relative to the total weight of the inorganic fibers, the organic binder and the inorganic binder.

The binder solution may contain a plurality of kinds of the aforementioned organic binders.

Moreover, as the binder solution, in addition to a latex formed by dispersing the organic binder in water, a solution or the like prepared by dissolving the organic binder in water or an organic solvent may be used.

In the case when an inorganic binder is contained in the binder solution, as the inorganic binder, for example, alumina sol, silica sol, or the like may be used.

The amount of the inorganic binder to be blended is not particularly limited as long as it can mutually combine inorganic fibers.

In the exhaust gas purifying system according to the embodiments of the present invention, after the holding sealing material has been subjected to a needling treatment, the holding sealing material is preferably impregnated with a binder solution. By the binder applied to the holding sealing material, the inorganic fibers forming the holding sealing material tend to be anchored with one another, with the result that the orientation of needle marks can be easily maintained.

In the exhaust gas purifying system according to the embodiments of the present invention, the number of the holding sealing materials is not particularly limited, and one sheet of the holding sealing material may be used, or a plurality of sheets of holding sealing materials mutually combined with one another may also be used.

As the method for combining the plurality of holding sealing materials, not particularly limited, for example, a method in which holding sealing materials are mutually stitched together by using a machine sewing process may be used, or a method in which holding sealing materials are mutually bonded to one another by using an adhesive tape, an adhesive material or the like may be used.

The material for the metal casing forming the exhaust gas purifying system according to the embodiments of the present invention is not particularly limited as long as it is a metal having sufficient heat resistance, and specific examples include: metals, such as stainless steel, aluminum and iron.

In the exhaust gas purifying system according to the embodiments of the present invention, in addition to a substantially cylindrical shape, the shape of the metal casing may be preferably prepared as a clam shell shape, a down-sizing type shape, or the like.

In the exhaust gas purifying system according to the embodiments of the present invention, the shape of the exhaust gas treating body is not particularly limited as long as it is a pillar shape, and in addition to a substantially round pillar shape, for example, a desired shape, such as a substantially cylindroid shape or a substantially rectangular pillar shape, with a desired size, may be used.

In the exhaust gas purifying system according to the embodiments of the present invention, the exhaust gas treating body may have an integrally formed structure as shown in FIG. 8A. Moreover, the exhaust gas treating body may have a structure in which a plurality of honeycomb fired bodies mainly including silicon carbide or the like, each having a shape in which a large number of cells are placed longitudinally in parallel with one another with a cell wall interposed therebetween, are combined with one after another with an adhesive layer mainly including a ceramic material being interposed therebetween.

In the exhaust gas purifying system according to the embodiments of the present invention, the exhaust gas treating body may have a catalyst supported thereon. As such a catalyst, examples thereof include: noble metals, such as platinum, palladium and rhodium, alkali metals, such as potassium and sodium, and alkaline earth metals, such as barium, or metal oxides and the like. These catalysts may be used alone, or two or more kinds of these may be used in combination.

As the above-mentioned metal oxide, not particularly limited as long as it can reduce the burning temperature of PMs, examples thereof include: $CeO_2$, $ZrO_2$, $FeO_2$, $Fe_2O_3$, CuO, $CuO_2$, $Mn_3O_2$ and MnO, or complex oxides indicated by the composition formula $A_nB_{1-n}CO_3$ (in the formula, A is La, Nd, Sm, Eu, Gd or Y, B is an alkali metal or alkaline earth metal, and C is Mn, Co, Fe or Ni, and $0 \leqq n \leqq 1$).

Each of these metal oxides may be used alone, or two or more kinds of these may be used in combination; however, it is desirable to include at least $CeO_2$.

By allowing the exhaust gas treating body to support such a metal oxide, it may be easier to reduce the burning temperature of PMs.

As the method for supporting a catalyst on the exhaust gas treating body, for example, a method in which, after having been impregnated with a solution containing a catalyst, the resulting exhaust gas treating body is heated, or a method in which a catalyst supporting layer made of an alumina film is formed on the surface of the exhaust gas treating body so that a catalyst is supported on this alumina film may be used.

As the method for forming the alumina film, for example, a method in which, after having been impregnated with a metal compound solution containing aluminum such as $Al(NO_3)_3$, the resulting exhaust gas treating body is heated, or a method in which, after having been impregnated with a solution containing alumina powder, the resulting exhaust gas treating body is heated may be used.

Moreover, as the method for supporting a catalyst on an alumina film, for example, a method in which an exhaust gas treating body on which an alumina film has been formed is impregnated with a solution or the like, containing noble metal, alkali metal, alkaline earth metal, or a metal oxide, and then heated may be used.

In the exhaust gas purifying system according to the embodiments of the present invention, in the case when a honeycomb structure is used as the exhaust gas treating body, no plug materials may be placed in the cells, and the ends of the cell may not be sealed. In this case, by supporting a catalyst such as platinum thereon, the exhaust gas treating body is allowed to function as a catalyst carrier for purifying toxic gas components, such as CO, HC or NOx, contained in exhaust gases.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An exhaust gas purifying system comprising:

an exhaust gas purifying apparatus having a first end portion and a second end portion opposite to said first end portion and comprising:

a metal casing;

an exhaust gas treating body housed in said metal casing; and a holding sealing material that is wound around a peripheral portion of said exhaust gas treating body and that is placed between said exhaust gas treating body and said metal casing;

an inlet pipe connected to said first end portion of said exhaust gas purifying apparatus so as to introduce exhaust gases into said exhaust gas purifying apparatus;

an exhaust pipe connected to said second end portion of said exhaust gas purifying apparatus so as to discharge said exhaust gases that have passed through said exhaust gas purifying apparatus; and said exhaust gas purifying apparatus being provided with a gas inlet side connected to said inlet pipe and a gas outlet side connected to said exhaust pipe, said holding sealing material being formed into a mat shape containing inorganic fibers, said holding sealing material having a first side face and a second side face, said first side face being positioned on said gas outlet side of said exhaust gas purifying apparatus, said second side face being positioned on said gas inlet side of said exhaust gas purifying apparatus, said first side face of said holding sealing material having a first slanting face formed on said first side face, said first slanting face having a first inside end point and a first outside end point on a cross section in parallel with a longitudinal direction of said exhaust gas purifying apparatus, said holding sealing material contacting said exhaust gas treating body at said first inside end point on said cross section, said holding sealing material contacting said metal casing at said first outside end point on said cross section, said first inside end point being positioned between said gas inlet side of said exhaust gas purifying apparatus and said first outside end point, said first slanting face extending from said first inside end point to said first outside end point and being tilted relative to an end face of said exhaust gas treating body.

2. The exhaust gas purifying system according to claim 1, wherein a second slanting face is formed on said second side face of said holding sealing material, on a cross section in parallel with the longitudinal direction of said exhaust gas purifying apparatus, said second slanting face has a second inside end point and a second outside end point, said holding sealing material contacting said exhaust gas treating body at said second inside end point, said holding sealing material contacting said metal casing at said second outside end point, said second inside end point is positioned between said gas inlet side of said exhaust gas purifying apparatus and said second outside end point, and said second slanting face extends from said second inside end point to said second outside end point and is tilted relative to an end face of said exhaust gas treating body.

3. The exhaust gas purifying system according to claim 1, wherein on a cross section in parallel with the longitudinal direction of said exhaust gas purifying apparatus, a first angle formed by an inner circumference of said metal casing and a line segment connecting said first inside end point to said first outside end point is from about 25° to about 89.5°.

4. The exhaust gas purifying system according to claim 1, wherein said holding sealing material has a plurality of needle marks formed by a needling treatment.

5. The exhaust gas purifying system according to claim 4, wherein said plurality of needle marks are formed in a direction diagonal to a thickness direction of said holding sealing material.

6. The exhaust gas purifying system according to claim 1, wherein a binder is applied to said holding sealing material.

7. The exhaust gas purifying system according to claim 6, wherein said binder applied to said holding sealing material has an amount of about 10% by weight or less.

8. The exhaust gas purifying system according to claim 1, wherein said metal casing has a distinguished gas inlet side and a distinguished gas outlet side, said distinguished gas inlet side forming said gas inlet side of said exhaust gas purifying apparatus, said distinguished gas outlet side forming said gas outlet side of said exhaust gas purifying apparatus.

9. The exhaust gas purifying system according to claim 2, wherein on a cross section in parallel with the longitudinal direction of said exhaust gas purifying apparatus, a second angle formed by an inner circumference of said metal casing and a line segment connecting said second inside end point to said second outside end point is from about 25° to about 89.5°.

10. The exhaust gas purifying system according to claim 1, wherein said first slanting face is formed over an entire portion of the first side face of said holding sealing material.

11. The exhaust gas purifying system according to claim 2, wherein said second slanting face is formed over an entire portion of the second side face of said holding sealing material.

12. The exhaust gas purifying system according to claim 1, wherein said exhaust gas treating body is a honeycomb structure in which cells are placed longitudinally in parallel with one another with a cell wall interposed between the cells.

13. A method for manufacturing an exhaust gas purifying system, comprising:

stuffing an exhaust gas treating body with a holding sealing material being wound around a peripheral portion of the exhaust gas treating body into a metal casing so as to manufacture an exhaust gas purifying apparatus, said exhaust gas treating body around which said holding sealing material has been wound being pushed from a side of a first side face of said holding sealing material, with a second side face of said holding sealing material being allowed to form a leading portion relative to a proceeding direction of said stuffing;

connecting an inlet pipe to a first end portion of said exhaust gas purifying apparatus to introduce exhaust gases into said exhaust gas purifying apparatus, the first end portion being closer to said second side face of said holding sealing material than to said first side face of said holding sealing material and being made to form a gas inlet side of said exhaust gas purifying apparatus; and connecting an exhaust pipe to a second end portion of said exhaust gas purifying apparatus to discharge said exhaust gases that have passed through said exhaust gas purifying apparatus, the second end portion being closer to said first side face of said holding sealing material than to said second side face of said holding sealing material and being made to form a gas outlet side of said exhaust gas purifying apparatus, said exhaust gas purifying system comprising:

said exhaust gas purifying apparatus having the first end portion and the second end portion opposite to the first end portion and comprising:

the metal casing;

the exhaust gas treating body housed in said metal casing; and the holding sealing material that is wound around the peripheral portion of said exhaust gas treating body and that is placed between said exhaust gas treating body and said metal casing;

the inlet pipe connected to the first end portion of said exhaust gas purifying apparatus so as to introduce exhaust gases into said exhaust gas purifying apparatus;

the exhaust pipe connected to the second end portion of said exhaust gas purifying apparatus so as to discharge said exhaust gases that have passed through said exhaust gas purifying apparatus; and said exhaust gas purifying apparatus being provided with said gas inlet side connected to said inlet pipe and said gas outlet side connected to said exhaust pipe, said holding sealing material being formed into a mat shape containing inorganic fibers, said holding sealing material having the first side face and the second side face, the first side face being positioned on said gas outlet side of said exhaust gas purifying apparatus, the second side face being positioned on said gas inlet side of said exhaust gas purifying apparatus, said first side face of said holding sealing material having a first slanting face formed on said first side face, said first slanting face having a first inside end point and a first outside end point on a cross section in parallel with a longitudinal direction of said exhaust gas purifying apparatus, said holding sealing material contacting said exhaust gas treating body at the first inside end point on the cross section, said holding sealing material contacting said metal casing at the first outside end point on the cross section, said first inside end point being positioned between said gas inlet side of said exhaust gas purifying apparatus and said first outside end point, said first slanting face extending from said first inside end point to said first outside end point and being tilted relative to an end face of said exhaust gas treating body.

14. The method for manufacturing said exhaust gas purifying system according to claim 13, wherein said metal casing has a distinguished gas inlet side and a distinguished gas outlet side, said distinguished gas inlet side forming said gas inlet side of said exhaust gas purifying apparatus, said distinguished gas outlet side forming said gas outlet side of said exhaust gas purifying apparatus, and said method further comprises, prior to said stuffing of said exhaust gas treating body with said holding sealing material, arranging said exhaust gas treating body around which said holding sealing material has been wound, with said second side face of said holding sealing material being allowed to form a leading portion relative to the proceeding direction of said stuffing, so that said first side face of said holding sealing material is positioned on said gas outlet side of said metal casing and said second side face of said holding sealing material is positioned on said gas inlet side of said metal casing.

15. The method for manufacturing said exhaust gas purifying system according to claim 13, wherein a second slanting face is formed on the second side face of said holding sealing material, on a cross section in parallel with the longitudinal direction of said exhaust gas purifying apparatus, the second slanting face has a second inside end point and a second outside end point, said holding sealing material contacting said exhaust gas treating body at the second inside end point, said holding sealing material contacting said metal casing at the second outside end point, said second inside end point is positioned between the gas inlet side of said exhaust gas purifying apparatus and said second outside end point, and said second slanting face extends from said second inside end point to said second outside end point and is tilted relative to an end face of said exhaust gas treating body.

16. The method for manufacturing said exhaust gas purifying system according to claim 13, wherein on a cross section in parallel with the longitudinal direction of the exhaust gas purifying apparatus, a first angle formed by an inner circumference of the metal casing and a line segment connecting said first inside end point to the first outside end point is from about 25° to about 89.5°.

17. The method for manufacturing said exhaust gas purifying system according to claim 13, wherein said holding sealing material has a plurality of needle marks formed by a needling treatment.

18. The method for manufacturing said exhaust gas purifying system according to claim 17, wherein said plurality of needle marks are formed in a direction diagonal to a thickness direction of said holding sealing material.

19. The method for manufacturing said exhaust gas purifying system according to claim 13, wherein a binder is applied to said holding sealing material.

20. The method for manufacturing said exhaust gas purifying system according to claim 19, wherein said binder applied to said holding sealing material has an amount of about 10% by weight or less.

21. The method for manufacturing said exhaust gas purifying system according to claim 15, wherein on a cross section in parallel with the longitudinal direction of said exhaust gas purifying apparatus, a second angle formed by an inner circumference of said metal casing and a line segment connecting said second inside end point to said second outside end point is from about 25° to about 89.5°.

22. The method for manufacturing said exhaust gas purifying system according to claim 13, wherein said first slanting face is formed over an entire portion of the first side face of said holding sealing material.

23. The method for manufacturing said exhaust gas purifying system according to claim 15, wherein said second slanting face is formed over an entire portion of the second side face of said holding sealing material.

24. The method for manufacturing said exhaust gas purifying system according to claim 13, wherein said exhaust gas treating body is a honeycomb structure in which cells are placed longitudinally in parallel with one another with a cell wall interposed between the cells.

25. A method for purifying exhaust gases using an exhaust gas purifying system, comprising:

introducing the exhaust gases discharged from an engine into an exhaust gas purifying apparatus of the exhaust gas purifying system through a gas inlet side of said exhaust gas purifying apparatus; and discharging the exhaust gases from a gas outlet side of said exhaust gas purifying apparatus, said exhaust gas purifying system comprising:

said exhaust gas purifying apparatus having a first end portion and a second end portion opposite to the first end portion and comprising:

a metal casing;

an exhaust gas treating body housed in said metal casing; and a holding sealing material that is wound around a peripheral portion of said exhaust gas treating body and that is placed between said exhaust gas treating body and said metal casing;

an inlet pipe connected to the first end portion of said exhaust gas purifying apparatus so as to introduce exhaust gases into said exhaust gas purifying apparatus;

an exhaust pipe connected to the second end portion of said exhaust gas purifying apparatus so as to discharge said exhaust gases that have passed through said exhaust gas purifying apparatus; and said exhaust gas purifying apparatus being provided with said gas inlet side connected to said inlet pipe and said gas outlet side connected to said exhaust pipe, said holding sealing material being formed into a mat shape containing inorganic fibers, said holding sealing material having a first side face and a second side face, the first side face being positioned on said gas outlet side of said exhaust gas purifying apparatus, the second side face being positioned on said gas inlet side of said exhaust gas purifying apparatus, said first side face of said holding sealing material having a first slanting face formed on said first side face, said first slanting face having a first inside end point and a first outside end point on a cross section in parallel with a longitudinal direction of said exhaust gas purifying apparatus, said holding sealing material contacting said exhaust gas treating body at the first inside end point on the cross section, said holding sealing material contacting said metal casing at the first outside end point on the cross section, said first inside end point being positioned between said gas inlet side of said exhaust gas purifying apparatus and said first outside end point, said first slanting face extending from said first inside end point to said first outside end point and being tilted relative to an end face of said exhaust gas treating body.

26. The method for purifying exhaust gases according to claim 25, wherein a second slanting face is formed on said second side face of said holding sealing material, on a cross section in parallel with the longitudinal direction of said exhaust gas purifying apparatus, said second slanting face has a second inside end point and a second outside end point, said holding sealing material contacting said exhaust gas treating body at the second inside end point, said holding sealing material contacting said metal casing at the second outside end point, said second inside end point is positioned between said gas inlet side of said exhaust gas purifying apparatus and said second outside end point, and said second slanting face extends from said second inside end point to said second outside end point and is tilted relative to an end face of said exhaust gas treating body.

27. The method for purifying exhaust gases according to claim 25, wherein on a cross section in parallel with the longitudinal direction of the exhaust gas purifying apparatus, a first angle formed by an inner circumference of the metal casing and a line segment connecting said first inside end point to the first outside end point is from about 25° to about 89.5°.

28. The method for purifying exhaust gases according to claim 25, wherein said holding sealing material has a plurality of needle marks formed by a needling treatment.

29. The method for purifying exhaust gases according to claim 28, wherein said plurality of needle marks are formed in a direction diagonal to a thickness direction of said holding sealing material.

30. The method for purifying exhaust gases according to claim 25, wherein a binder is applied to said holding sealing material.

31. The method for purifying exhaust gases according to claim 30, wherein said binder applied to said holding sealing material has an amount of about 10% by weight or less.

32. The method for purifying exhaust gases according to claim 25, wherein said metal casing has a distinguished gas inlet side and a distinguished gas outlet side, the distinguished gas inlet side forming said gas inlet side of said exhaust gas purifying apparatus, the distinguished gas outlet side forming said gas outlet side of said exhaust gas purifying apparatus.

33. The method for purifying exhaust gases according to claim 26, wherein on a cross section in parallel with the longitudinal direction of said exhaust gas purifying apparatus, a second angle formed by an inner circumference of said metal casing and a line segment connecting said second inside end point to said second outside end point is from about 25° to about 89.5°.

34. The method for purifying exhaust gases according to claim 25, wherein said first slanting face is formed over an entire portion of the first side face of said holding sealing material.

35. The method for purifying exhaust gases according to claim 26, wherein said second slanting face is formed over an entire portion of the second side face of said holding sealing material.

36. The method for purifying exhaust gases according to claim 25, wherein said exhaust gas treating body is a honeycomb structure in which cells are placed longitudinally in parallel with one another with a cell wall interposed between the cells.

* * * * *